US005828357A

United States Patent [19]

Tamai et al.

[11] Patent Number: 5,828,357

[45] Date of Patent: Oct. 27, 1998

[54] DISPLAY PANEL DRIVING METHOD AND DISPLAY APPARATUS

[75] Inventors: Shigeki Tamai, Kashihara; Yoshinori Ogawa, Yamatotakada, both of Japan

[73] Assignee: Sharp Kabushiki Kaisha, Osaka, Japan

[21] Appl. No.: 680,267

[22] Filed: Jul. 11, 1996

[30] Foreign Application Priority Data

Mar. 27, 1996 [JP] Japan ..... 8-071681

[51] Int. Cl.[6] ..... G09G 3/36

[52] U.S. Cl. ..... 345/89; 345/95; 345/210

[58] Field of Search ..... 345/89, 87, 94, 345/95, 208, 210, 147, 50, 51, 53; 349/33, 34; 348/790, 792, 793

[56] References Cited

U.S. PATENT DOCUMENTS

| | | | |
|---|---|---|---|
| 5,602,561 | 2/1997 | Kawaguchi et al. | 345/89 |
| 5,604,510 | 2/1997 | Blanchard | 345/89 |
| 5,621,426 | 4/1997 | Okada et al. | 345/89 |
| 5,640,174 | 6/1997 | Kamei et al. | 345/89 |

FOREIGN PATENT DOCUMENTS

| | | |
|---|---|---|
| 4214594 | 8/1992 | Japan . |
| 5297833 | 11/1993 | Japan . |
| 750389 | 5/1995 | Japan . |

OTHER PUBLICATIONS

English language abstract of JP–A 5–297833.
English language abstract of JP–B2 7–50389.
English language abstract of JP–A 4–214594.

*Primary Examiner*—Dennis-Doon Chow

[57] ABSTRACT

In a display apparatus for performing multiple-level gradation display, the number of connection terminals of the drive circuit thereof is reduced so as to reduce the number of analog switches in the drive circuit. First and second reference voltages which rise stepwise with time are supplied to analog switches that are selectively turned on and off in accordance with gradation display data elements. Among potentials included in the changing first and second reference voltages, a potential corresponding to gradation display data is supplied to the pixel electrodes via source lines to perform gradation display in accordance with the gradation display data.

20 Claims, 25 Drawing Sheets

FIG. 6A PRIORART

CK CLOCK
D0~D2 GRADATION DISPLAY DATA
HOLD SIGNAL LS
FR
CLK GRADATION CLOCK
SECOND REFERENCE VOLTAGE
FIRST REFERENCE VOLTAGE
SR
SHIFT REGISTER
SR1
SR2
SRN
DM
DATA MEMORY
DM1
DM2
DMN
SE
SELECTOR
SE1
SE2
SEN
CNT
LOAD
CLK
D SUBTRACTION COUNTER
CNT1
CNT2
CNTN
45
46
DE
DETECTION DECODER
DE1
DE2
DEN
42b
42a
SW
SW1a
SW1b
SW2a
SW2b
SWNa
SWNb
DS
DS1
DS2
DSN
Vh
S1
O1
S2
O2
SN
ON
137, 137a
137b

DISPLAY PANEL DRIVING METHOD AND DISPLAY APPARATUS

BACKGROUND OF THE INVENTION

1. Field of the Invention

The present invention relates to a method for driving a display panel, such as an active matrix type liquid crystal display panel, and also relates to a display apparatus.

2. Description of the Related Art

A first prior art, that is, a typical prior art, is shown in FIG. 20. In an active matrix type liquid crystal display panel 11 constituting a display apparatus 10, source lines O1 to ON and gate lines L1 to LM are formed in a matrix. At each intersection of the lines, a thin film transistor T is disposed. Voltages at the source lines O1 to ON are selectively supplied to pixel electrodes P via the transistors T.

The source lines O1 to ON are connected to a source driver 12 formed by a semiconductor integrated circuit. In accordance with display data D0 to D2 of the respective bits of 3-bit display data corresponding to each source line Ok (k=1 to N) , the source driver 12 supplies one of eight reference voltages V0 to V7 supplied from a reference voltage source 13 to the source lines O1 to ON via terminals S1 to SN. (Hereinafter, display data of one bit, which is a component of n-bit display data, is described as a display data element.) A gate driver 14 formed by a semiconductor integrated circuit delivers gate signals G1 to GM to gate lines L1 to LM. In a single horizontal scanning period, the source driver 12 supplies a reference voltage, which is generated in accordance with the display data elements D0 to D2 and corresponds to each pixel electrode P supplied with a gate signal Gj (j=1 to M), to the source line Ok.

FIG. 21 is a block diagram specifically showing a partial constitution of the source driver 12 of the first prior art shown in FIG. 20. The source driver 12 is provided with decoder circuits FRk (k=1 to N) corresponding to the source lines O1 to ON, respectively. In response to data d0 to d2 corresponding to the display data elements D0 to D2, respectively, the source driver 12 selects and supplies one of eight different reference voltages V0 to V7 from the reference voltage source 13, to a source line Ok via analog switches ASW0 to ASW7 so as to offer eight-level gradation display. In the first prior art shown in FIGS. 20 and 21, reference voltages V0 to V7 individually corresponding to the gradation levels are supplied to the source driver 12 from the reference voltage source 13. The source driver 12 requires connection terminals supplied with the reference voltages V0 to V7 and the number of the connection terminals is the same as that of the reference voltages. In addition, the source driver 12 also requires the analog switches individually corresponding to gradation levels so as to output the reference voltages.

The on-time resistances of the analog switches ASW0 to ASW7 in the source driver 12 must be sufficiently low so that the levels of the selected reference voltages V0 to V7 are accurately written at the source lines O1 to ON of the display panel 11 externally connected to the source driver 12. Accordingly, the area occupied by the analog switches ASW0 to ASW7 in the semiconductor chip of the source driver 12 is larger generally more than ten times to several tens of times than that occupied by the logic circuit devices on/off-controlled for logic operation in the source driver 12.

Because of the above-mentioned reasons, the ratio of the area occupied by the analog switches ASW0 to ASW7 to the total area occupied by the source driver 12 is large.

Consequently, the increase of analog switch in number, caused by increase in gradation level leads directly to increase in size of the semiconductor chip on which the source driver 12 is formed.

These days, such a semiconductor chip in which the source driver 12 or the like is formed is desired to be miniaturized to reduce production cost. To miniaturize the chip, an attempt has been taken place to miniaturize terminals for supplying signals, voltages and the like. However, there is a limit in miniaturizing the terminals themselves. For further miniaturization, for example, it is necessary to reduce the number of connection terminals. Furthermore, the semiconductor chip in which the source driver 12 made of semiconductor integrated circuit is formed can be miniaturized by reducing the number of analog switches.

To perform 16-level gradation display in the first prior art by using 4-bit display data, for example, connection terminals for supplying 16-different reference voltages are required. In addition, 16 analog switches corresponding to the reference voltages are required in total. In reality, the mass production of the source driver 12 for display in more gradation levels, such as 64 and 256 levels, has become impossible.

A second prior art has been disclosed in Japanese Unexamined Patent Publication JP-A 4-214594, wherein such a semiconductor chip is miniaturized by reducing the number of connection terminals supplied with reference voltages and also by reducing the number of analog switches. FIG. 22 shows a schematic configuration of the display apparatus disclosed in the above-mentioned patent publication.

One of a pair of LCD substrates, between which a liquid crystal layer is disposed, is provided with pixel electrodes 16, drain lines 17, gate lines 18, and switching devices 19 which are disposed at the intersections of the drain lines 17 and the gate lines 18 and supplies the voltages developed on the drain lines 17 to the pixel electrodes 16. The other substrate is provided with data electrodes 20 for each row, extending in the vertical direction in FIG. 22.

A scanning circuit 21 supplies control pulses to the gate lines 18 to perform sequential scanning. Within each horizontal scanning period, a reference gradation signal having a voltage changing regularly is applied to the pixel electrodes 16 via the drain lines 17. In other words, a ramp waveform voltage which rises or drops with time is commonly supplied to the drain lines 17 from a single reference gradation signal circuit 23 within a single horizontal scanning period.

A data signal is supplied to the data electrode 20 from a signal supply circuit 22. A voltage level is determined only in a period corresponding to a gradation level indicated by the data signal within a horizontal scanning period. In the remaining period, a high impedance state occurs. In other words, a voltage, the level of which is determined within only the period corresponding to the gradation level, is supplied to the data electrode 20. Accordingly, the gradation level is adjusted depending on the length of the period during which the voltage level at the data electrode has been determined.

In the above-mentioned second prior art, there is a great problem that a plurality of data electrodes 20 grouped for each row must be provided on the other substrate. The other substrate facing opposite to the pixel electrodes 16 of a liquid crystal display panel, which has been used widely in these days, has a single common electrode formed for all of the plurality of the pixel electrodes 16. Therefore, when executing the prior art, the display panel itself must be redesigned, which makes the execution of the prior art difficult.

Furthermore, in the second prior art, since the gradation level is held at the data electrodes 20 side, the auxiliary capacitances for data storage, which have been formed on the one of the substrates of the display panel, which has been used generally, cannot be utilized without modification. In addition, a third prior art has been disclosed in Japanese Unexamined Patent Publication JP-A 5-297833. A schematic configuration of the prior art is shown in FIG. 23. A shift register 27 controls the timing of writing input data composed of four bits for each of three colors R, G and B into a data register 28 in accordance with a clock signal CLK. When input data for a single line is written into the data register 28, the written data for the single line is transferred to a data latch circuit 29 in parallel and held.

The data held in the data latch circuit 29 are supplied to a comparison circuit 30 at a predetermined timing. In the comparison circuit 30, the data for each of the colors R, C and B from the data latch circuit 29 is compared with a 4-bit count value delivered from a 4-bit counter 31, and a result of the comparison is supplied to a selector-contained sample-and-hold circuit 32. To the selector-contained sample-and-hold circuit 32, in addition to the results of the comparison at the comparison circuit 30, stepwise waveform voltages VR, VB, the levels of which change in accordance with predetermined eight and two steps respectively, are supplied from stepwise waveform voltage generation circuits 33, 34 respectively.

The selector-contained sample-and-hold circuit 32 samples and holds the signals from the stepwise waveform voltage generation circuits 33, 34 depending on the results of the comparison at the comparison circuit 30 by using sample-and-hold capacitors contained in the selector-contained sample-and-hold circuit 32. An output buffer 35, supplied with a voltage VDD, delivers signal voltages depending on the charge voltage levels charged in the capacitors in the selector-contained sample-and-hold circuit 32, each signal voltage for each of the colors R, G and B, and supplies each signal voltage to the line of each column.

In the third prior art, the selector-contained sample-and-hold circuit 32 has the sample-and-hold capacitors. The potential due to the charge stored in each capacitor is outputted through a voltage follower by an operational amplifier provided for each line in the output buffer 35. Therefore, the outputs of the stepwise waveform voltage generation circuits 33, 34 are supplied only to the capacitors of the selector-contained sample-and-hold circuit 32, but not supplied directly to the lines of the display panel. Since the voltages amplified by the operational amplifiers provided in the output buffer 35 are supplied to the lines of the display panel, the voltages supplied to the lines are changed undesirably because of the variation in the characteristics of the operational amplifiers, which causes deterioration in display quality. The variation in the characteristics of the operational amplifiers occurs because of the existence of output voltage deviation due to the fluctuation of the input offset voltage, a narrow output voltage range due to the limited dynamic range of the operational amplifier, or the like, for example.

Additionally, a fourth prior art has been disclosed in Japanese Examined Patent Publication JP-B2 7-50389. FIG. 24 is a block diagram showing a configuration of an X driver 120 for driving source electrodes disclosed in the publication. FIG. 25 is a timing chart for signals used in the X driver 120.

A shift register 121 controls the timing of writing 4-bit data input signals PD1 to PD4 into the half latch 129 of a latch-A circuit 122 in accordance with a start pulse VSP and a clock signal XCL. The latch circuit 122 is provided with M groups of half latches 129 composed of four D-type flip-flops. When data is held in the M groups of half latches 129, the latch clock signal LCL shown in FIG. 25 is inputted to the half latches 130 of the latch-B circuit 123 to hold the data.

A 4-bit binary counter 124 is reset by a latch clock signal LCL and counts the number of pulses in the fundamental signal F16 for gradation shown in FIG. 25. The outputs QA to QD of the binary counter 124 and the outputs of the half latch 130 are inputted to each of M pieces of comparators 138 in a comparator 125, and a result of the comparison is supplied to an input D of a D-type flip-flop circuit 126 as an output signal Y shown in FIG. 25. The D-type flip-flop circuit 126 takes the output of the comparator 138 in synchronization with the rise of the fundamental signal F16 for gradation. The D-type flip-flop circuit 126 is set by the latch clock signal LCL and reset by a stop signal STOP. The output of the D-type flip-flop circuit 126 is raised to a voltage capable of driving analog switches 128 by a level shifter 127.

The analog switches 128 are supplied with the video voltage VID shown in FIG. 25 and are on/off-controlled by the outputs of the level shifter 127. The video voltage VID changes linearly from the off-level voltage VOFF to the on-level VON of the liquid crystals in a single horizontal scanning period TH.

By the on/off control operation of the analog switch 128, the video voltage VID changing as described above is applied to a pixel electrode of the liquid crystal display panel via a source signal line as a voltage Vpix shown in FIG. 25. The level of the voltage Vpix at rise time ta of the fundamental signal F16 for gradation after the output signal Y is lowered is held until time tb when the horizontal scanning period TH ends.

In the fourth prior art, since the video voltage VID supplied to the source electrode via the analog switch 128 has a linear sawtooth waveform, when the output signal timing of the comparator 138 is deviated slightly, a desired voltage cannot be held, but a voltage obtained at a slightly deviated timing is held. This voltage difference degrades display quality.

Furthermore, in all the above-mentioned prior arts, the charges stored in the liquid crystal element are not discharged. This causes a problem that the charges stored at the preceding display timing remain in the liquid crystal element, whereby the voltage with which the liquid crystal element is charged does not coincide with the voltage indicated by gradation display data. For example, after display was performed by applying a high voltage to the liquid crystal element, when display is attempted at the next display timing by applying a voltage which is lower than that applied at the preceding display timing, the charges stored in the preceding display timing remain unless the charges held in the liquid crystal element are discharged. This may reduce the display quality of the liquid crystal display panel.

SUMMARY OF THE INVENTION

An object of the present invention is to provide a display panel driving method and a display apparatus, wherein a semiconductor chip, such as a source driver, can be made smaller in size, lower in power consumption and higher in packaging density by reducing the number of connection terminals and the number of analog switches while ensuring multiple-level gradation.

Another object of the invention is to provide a display panel driving method and a display apparatus, wherein a commonly used display panel is provided with a plurality of pixel electrodes disposed on one of two substrates and also provided with a single common electrode disposed on the other substrate facing opposite to the former substrate through a dielectric layer such as a liquid crystal layer, sandwiched therebetween, is used without modification, and wherein the number of connection terminals and the number of analog switches can be reduced as described above.

Still another object of the invention is to provide a display panel driving method and a display apparatus, wherein complicated circuit structures such as operational amplifiers as used in the prior art and shown in FIG. 23 are not used, deterioration in display quality due to variation in characteristics of such semiconductor devices can be prevented, and semiconductor chips such as a source driver and the like can be made smaller in size and lower in power consumption.

The invention provides several embodiments of a display apparatus including a display panel for performing gradation display by applying a voltage across a pair of electrodes, and a voltage source for outputting a first voltage changing from a predetermined first potential to a second potential higher than the first potential, at intervals of a predetermined period, and a second voltage changing from the second potential to a third potential higher than the second potential, at intervals of the predetermined period. The voltage applies the first potential or a potential lower than the first potential, or applies the third potential or a potential higher than the third potential, to one electrode of the pair of electrodes of the display panel by switching at intervals of the predetermined period or at intervals of a period plural times the predetermined period. The display apparatus also includes a driving device used for receiving the first and second voltages, sampling one of the first and second voltages selected on the basis of data for performing gradation display at intervals of the predetermined period, and applying the sampled voltage to the other electrode of the pair of electrodes.

Furthermore, the first and second voltages of the invention change linear-functionally in the predetermined period.

Furthermore, the first and second voltages of the invention build up or drop stepwise in the predetermined period.

According to a preferred embodiment of the invention, the driving device applies a potential corresponding to gradation display data from among potentials in the changeable ranges of the first and second voltages which rise or drop stepwise with time, supplied from the voltage source, to the other electrode of the display panel. The driving means also applies the first potential or a potential lower than the first potential, applies or the third potential or a potential higher than the third potential selected by switching at intervals of a predetermined period or multiple number of periods to one electrode in order to perform gradation display on the display panel. Therefore, it is acceptable that the potential corresponding to the gradation display data is a potential included in the first or second voltage, and the differences in the changing potentials of the first and second voltages in each period can be reduced. A desired potential can thus easily be applied to the display panel to perform gradation display. In addition, when the first and second voltages change stepwise, a period having a certain potential can be taken relatively long. Consequently, the potential corresponding to the gradation display data can easily be applied to the other electrode to perform gradation display.

Furthermore, the driving device can include two switching devices which are supplied with the first and second voltages from the voltage source, respectively, and whose outputs are supplied to the other electrode in common, and turns on one of the switching devices, selected in accordance with gradation display data.

According to an embodiment of the invention, the switching devices respectively supplied with the first and second voltages are disposed between the voltage source and the other electrode of the display panel, and the driving device controls the on/off operation of the switching devices in accordance with gradation display data. Accordingly, one of the switching devices is turned on in accordance with the gradation display data, and one of the voltages supplied to the switching device is supplied to the other electrode. As a result, a desired potential can be applied to the other electrode without being affected by the other voltage.

Furthermore, the invention provides a method of driving a display panel for performing m-level gradation display (m: an integer of 2 or more) by application of a voltage across a pair of electrodes through a dielectric layer disposed therebetween, the method including dividing a range from a predetermined low potential to a potential higher than the low potential into n potential segments (n: a divisor of m excluding 1 and m) and creating first to nth voltages changing from the lowest potential to the highest potential, or from the highest potential to the lowest potential, in each potential segment in a predetermined period. The method also includes applying the low potential or a potential lower than the low potential, or the high potential or a potential higher than the high potential to the other electrode of the display panel by switching at intervals of the predetermined period or at intervals of a period plural times the predetermined period. A potential is selected corresponding to a number of gradation levels for desired display from among the potentials changing in the range of the first and nth voltages, on the basis of the potential applied to the one electrode, applying the selected potential to the other electrode, and holding the voltage across the one electrode and the other electrode at the dielectric layer to perform gradation display.

Furthermore, in the invention, the first to nth voltages change linear-functionally in the potential segment.

Furthermore, in the invention, the first to nth voltages rise or drop in m/n steps in the potential segment.

According to the invention, the low potential or a potential lower than the low potential, or the high potential or a potential higher than the high potential is applied to the one electrode by switching at intervals of a predetermined period or at intervals of a multiple period of the predetermined period, and among the first to nth voltages with potentials changing with time, a potential at a certain time. The potential corresponds gradation display data is applied to the other electrode to perform gradation display on the display panel. Therefore, it is acceptable that the potential corresponding to the gradation display data is a potential included in one of the first to nth voltages changing at intervals of the predetermined period. Therefore, the differences in the changing potentials of the first to nth voltages in each period can be reduced. A desired potential can thus easily be applied to the other electrode to perform gradation display. In addition, when the first to nth voltages change stepwise, a period having a certain potential can be taken relatively long. Consequently, the potential corresponding to the gradation display data can be easily applied to the other electrode to perform gradation display.

Furthermore, an other embodiment of the invention provides a display apparatus including a display panel in which drive voltages supplied to pixel electrodes disposed at intersections of first and second lines arranged in a matrix form, via first lines, are supplied via pixel switching devices turned on by a pixel control signal supplied via the second lines. A and a constant reference voltage is applied to a common electrode disposed facing opposite to the pixel electrodes, whereby potential differences are obtained between the pixel electrodes and the common electrode to perform gradation display . The display apparatus of this embodiment also includes a—;

second line driving device for sequentially supplying the pixel control signal to the second lines in a plurality of predetermined horizontal scanning periods to turn on the pixel switching devices connected to the second lines, and a voltage source for generating a voltage which rises or drops stepwise with time in each horizontal scanning period. The voltage source generates:

a first voltage which rises stepwise from a predetermined first potential to a second potential higher than the first potential, or drops stepwise from the second potential to the first potential, and a second voltage which rises stepwise from the second potential to a third potential higher than the second potential, or drops stepwise from the third potential to the second potential.

The first potential or a potential lower than the first potential and the third potential or a potential higher than the third potential is applied as the constant reference voltage to the common electrode by switching at intervals of a predetermined period; and the first line driving device applies one of the changing potentials of the first and second voltages in accordance with gradation display data to pixel electrodes via the respective first lines in the horizontal scanning period.

According to the invention, the first line driving device applies a predetermined potential selected from the first and second voltages which rise and drop stepwise with time and supplied from the voltage source to the pixel electrodes via the first lines of the display panel in accordance with gradation display data in a horizontal scanning period. In addition, the second line driving device sequentially supplies the pixel control signal to the second lines of the display panel in each horizontal scanning period to turn on the pixel switching devices. Furthermore, the common electrode is supplied with the first potential or a potential lower than the first potential and the third potential or a potential higher than the third potential by switching at intervals of a predetermined period. Gradation display is performed by a voltage generated owing to the potential applied between the common electrode and the pixel electrodes. Therefore, it is acceptable that the potential corresponding to the gradation display data is a potential included in one of the first and second voltages. Consequently, the differences in the changing potentials of the first and second voltages in a single horizontal scanning period can be reduced. A desired potential can thus easily be applied to the pixel electrodes via the first lines of the display panel to perform gradation display.

Furthermore, in the invention, the first line driving device includes:

a gradation display data generation device for delivering gradation display data in serial bits sequentially for each first line in the horizontal scanning period, a data latch circuit for delivering gradation display data in parallel bits from the gradation display data generation device while latching the data in each horizontal scanning period, a gradation clock signal generation device for sequentially generating gradation clock signals, whose number is more than that of gradation levels to be used for gradation display, in each horizontal scanning period, first and second voltage application switching devices disposed between the voltage source and the pixel electrodes and supplied with the first and second voltages, respectively, and a switching control device for applying voltages to the pixel electrodes by turning on or off the voltage application switching device in response to outputs of the data latch circuit after a lapse of time corresponding to the gradation display data.

The switching control device includes a subtraction counter, wherein a value corresponding to gradation display data is set and the value is subtracted each time the gradation clock signal is received, and also controls the on/off operation of the first and second voltage application switching devices when the counted value of the subtraction counter reaches a predetermined value.

According to the invention, gradation display data generated sequentially from the gradation display data generation device are held and latched by the data latch circuit of the first line driving device in each horizontal scanning period, and then outputted to the switching control device. The gradation clock signals are supplied from the gradation clock signal generation device to the subtraction counter of the switching control device, and a value determined in accordance with gradation display data is subtracted sequentially. The switching control device controls the on/off operation of the first and second voltage application switching devices in accordance with the value of the subtraction counter. The first and second voltages which rise or drop stepwise are supplied to the first and second voltage application switching devices, and the potential in accordance with the gradation display data is applied to the pixel electrodes. Therefore, it is acceptable that the potential corresponding to the gradation display data is a potential included in one of the first and second voltages. Consequently, the differences in the changing potentials of the first and second voltages in a single horizontal scanning period can be reduced. A desired potential can thus easily be applied to the pixel electrodes via the first lines of the display panel to perform gradation display.

Furthermore, in the invention the first and second voltage application switching devices are analog switches.

According to the invention, since the first and second voltage application switching devices are analog switches, even when the first and second voltages rise or drop stepwise, a desired potential of the changing potentials of the first and second voltages supplied from the voltage source can easily be applied to the pixel electrodes via the first lines of the display panel to perform gradation display.

Furthermore, in the invention the first and second voltage application switching devices are P-channel type MOS transistors in the case where voltages which rise stepwise are supplied, and are N-channel type MOS transistors in the case where voltages which drop stepwise are supplied.

According to the invention, when the first and second voltages are voltages which rise stepwise, the voltage application switching devices which are supplied with the voltages are P-channel MOS transistors. When the first and second voltages are voltages which drop stepwise, the voltage application switching devices which are supplied with the voltage are N-channel MOS transistors. Therefore, the first and second voltage application switching devices can be transistors conductive in either direction, whereby the area of the devices for driving the display panel can be reduced. Furthermore, a desired potential of the changing potentials of the first and second voltages supplied from the voltage source can easily be applied to the pixel electrodes via the first lines of the display panel to perform gradation display.

Furthermore, in the invention an analog switch which is turned on at the end of each horizontal scanning period to supply the second potential to the pixel electrodes, is disposed between the first and second potential application switching devices and the pixel electrode.

According to the invention, the analog switch is turned on at the end of each horizontal scanning period and the second potential is supplied to the pixel electrodes. Therefore, the potential which was applied to the pixel electrodes in the preceding horizontal scanning period is changed to the second potential. Consequently, even when a potential to be applied to the pixel electrode varies significantly according to the horizontal scanning periods, the display quality on the display panel can be prevented from being degraded.

In particular, when the first voltage drops stepwise from the second potential to the first potential, when the first voltage application switching device is an N-channel MOS transistor, when the second voltage rises stepwise from the second potential to the third potential, and when the second voltage application switching device is a P-channel MOS transistor, the voltage application switching devices can be made smaller. In addition, since the initial potential in each horizontal scanning period is the second potential which is the potential at the start time in each of the voltages, display on the display panel can be performed without being affected by the potentials of the charges held in the pixel electrodes.

As described above, according to the invention, it is acceptable that the potential corresponding to the gradation display data is a potential included in one of the first and second voltages. Consequently, the differences in the changing potentials of the first and second voltages in each period can be reduced. A desired potential can thus easily be applied to the display panel to perform gradation display. In addition, the driving device can function satisfactorily when supplied with the two different voltages, namely the first and second voltages, which change with time. Therefore, the number of terminals for supplying voltages to the driving means can be reduced.

Furthermore, according to the invention, when the first and second voltages change stepwise, the period for each potential can be taken relatively long. Therefore, a potential in accordance with gradation display data can easily be applied to the other electrode to perform gradation display.

Furthermore, according to the invention, the switching devices respectively supplied with the first and second voltages are disposed between the voltage source and the other electrodes of the display panel, and the switching devices are on/off-controlled in accordance with gradation display data. Therefore, one of the switching devices is turned on in accordance with the gradation display data, and the voltage supplied to the switching device is supplied to the other electrode. Consequently, a desired potential can be applied to the other electrode without being affected by the other voltage. Furthermore, since the on/off operations of the two switching devices are controlled in accordance with gradation display data to perform gradation display, the number of the switching devices provided for the display apparatus can be reduced.

Furthermore, according to the invention, the low potential or a potential lower than the low potential and the high potential or a potential higher than the high potential are selected by switching at intervals of a predetermined period or at intervals of a period plural times the predetermined period and applied to the one electrode, and among the first to nth voltages changing in potential with time, a potential corresponding to gradation display data, namely a potential at a certain time is applied to the other electrode to perform gradation display on the display panel. Therefore, it is acceptable that the potential corresponding to the gradation display data is a potential included in one of the first to nth voltages changing at intervals of the predetermined period. Consequently, the differences in the changing potentials of the first to nth voltages at intervals of the predetermined period can be reduced. A desired potential can thus easily be applied to the other electrode to perform gradation display.

Furthermore, according to the invention, when the first to nth voltages change stepwise, a period having a certain potential can be taken relatively long. Therefore, a potential in accordance with gradation display data can easily be applied to the other electrode to perform gradation display.

Furthermore, according to the invention, it is acceptable that a potential corresponding to gradation display data is included in the first or second voltage. Therefore, the differences between the changing potentials of the first and second voltages in a single horizontal scanning period can be reduced. A desired potential can thus easily be applied to the first lines of the display panel to perform gradation display.

Furthermore, according to the invention, since the first and second voltage application switching devices are analog switches, even when the first and second voltages rise or drop stepwise, a desired potential selected from the first and second voltages supplied from the voltage source can easily be applied to the first lines of the display panel to perform gradation display.

Furthermore, according to the invention, when the first and second voltages which rise stepwise are supplied to the voltage application switching devices, the P-channel MOS transistor is turned on. When the voltages which drop stepwise are supplied to the voltage application switching devices, the N-channel MOS transistor is turned on. Therefore, the first and second voltage application switching devices can be composed of a transistor conductive in either N-type or P-type, whereby the area of the devices for driving the display panel can be reduced.

Furthermore, according to the invention, a potential which was applied to the pixel electrodes in the preceding horizontal scanning period is changed to the second potential. Consequently, even when a potential to be applied to the pixel electrodes varies significantly according to the horizontal scanning periods, the display quality on the display panel can be prevented from being degraded.

In particular, when the first voltage lowers stepwise from the second potential to the first potential, the first voltage application switching device is an N-channel MOS transistor, the second voltage rises stepwise from the second potential to the third potential, and the second voltage application switching device is a P-channel MOS transistor, the voltage application switching devices can be made smaller. In addition, since the initial potential in each horizontal scanning period is the second potential which is the potential at the start time in each of the voltages, display on the display panel can be performed without being affected by the potentials of the charges held in the pixel electrodes.

BRIEF DESCRIPTION OF THE DRAWINGS

Other and further objects, features, and advantages of the invention will be more explicit from the following detailed description taken with reference to the drawings wherein:

FIG. 6A is a waveform chart showing a reference voltage changing stepwise in a single horizontal scanning period WH;

DETAILED DESCRIPTION OF THE PREFERRED EMBODIMENTS

Figure 1:
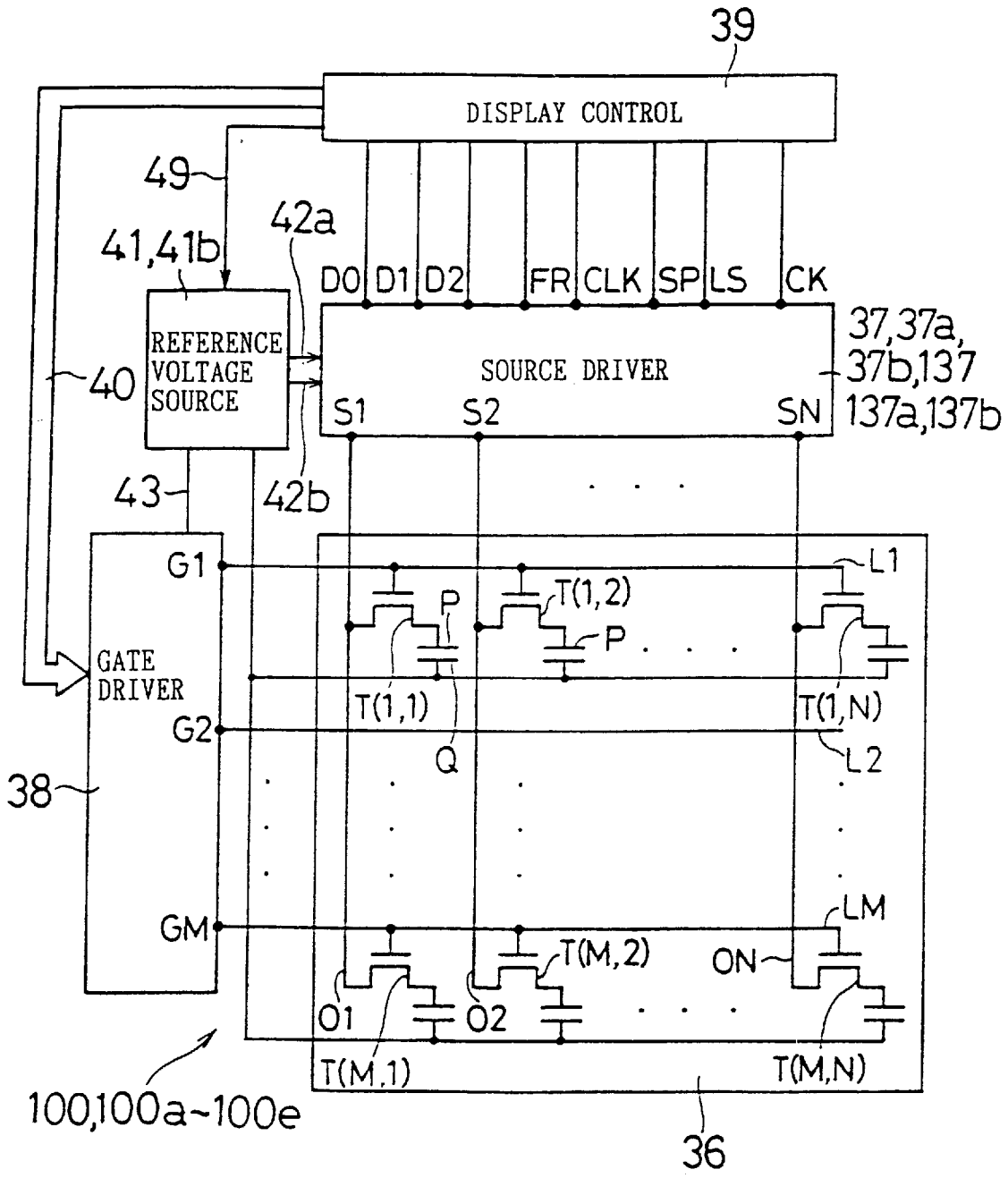
FIG. 1 is a block diagram showing the configuration of a liquid crystal display apparatus 100 of a first embodiment of the invention.

Now referring to the drawings, preferred embodiments of the invention are described below.

FIG. 1 is a block diagram showing the configuration of a liquid crystal display apparatus 100 of a first embodiment of the invention. The liquid crystal display apparatus 100 comprises a liquid crystal display panel 36, a source driver 37, a gate driver 38, a display control circuit 39 and a reference voltage source circuit 41.

In the active matrix type liquid crystal display panel 36, source lines O1 to ON, a first line group, and gate lines L1 to LM, a second line group, are arranged in a matrix with M rows and N columns on one of two substrates.

Thin-film transistors (abbreviated as TFT) T (j, i) (j=1 to M, i=1 to N), pixel switching devices, are arranged at the intersections of the lines O1 to ON and the lines L1 to LM.

The thin-film transistors T, the gate electrodes of which are connected to the gate lines Lj supplied with gate signals Gj, are turned on when gate signals G1 to GM are supplied sequentially to the gate lines L1 to LM. Accordingly, the gradation display drive voltages from the source lines O1 to ON are supplied to pixel electrodes P (j, i) via the thin-film transistors T which are turned on.

On the other substrate facing opposite to the substrate through liquid crystals, a single common electrode Q facing opposite to all the pixel electrodes P is formed. Display with gradation is performed by electric fields formed between the common electrode Q and the pixel electrodes P selectively supplied with drive voltages. With reference to a predetermined voltage value, a voltage having a polarity opposite to that of the drive voltages is applied to the common electrode Q. In FIG. 1, the common electrode Q is shown dividedly to show that display at each pixel is performed by the combination of each pixel electrode P and the common electrode Q.

The source lines O1 to ON are connected respectively to the connection terminals S1 to SN of the source driver 37 implemented by a semiconductor integrated circuit. The gate lines L1 to LM are connected respectively to the connection terminals G1 to GM of the gate driver 37 also implemented by a semiconductor integrated circuit. In this specification, connection terminals and signals supplied to the connection terminals may be represented by the same reference codes.

In each horizontal scanning period WH wherein the levels of the gate lines L1 to LM go high sequentially, the thin-film transistor T, a pixel switching device, the gate electrode of which is connected to the gate line Lj having a high level is turned on. Accordingly, the drive voltage corresponding to gradation display data and supplied via the source lines O1 to ON is used to charge the liquid-crystal-layer provided between the pixel electrode P and the common electrode Q. The voltage level after the charge is held in a single vertical scanning period during which M pieces of gate lines L1 to LM in total are scanned.

In the source driver 37, display data elements D0 to D2 of the respective bits of serial 3-bit gradation display data are supplied sequentially from the display control circuit 39 to the source lines O1 to ON. Furthermore, the display control circuit 39 generates a clock signal CK, a hold signal LS, a gradation clock signal CLK, a start pulse signal SP and an AC-converting signal FR and supplies these signals to the source driver 37. These reference codes, D0 to D2, CK, LS, CLK, SP and FR, may be used to represent signals, connection terminals and lines. Other reference codes may also be used in similar ways.

Signals in synchronization with the clock signal CK and the hold signal LS are also supplied from the display control circuit 39 to the gate driver 38 via a line 40. The gate driver 38 supplies the gate signals G1 to GM sequentially to the gate lines L1 to LM as described above.

Figure 10:
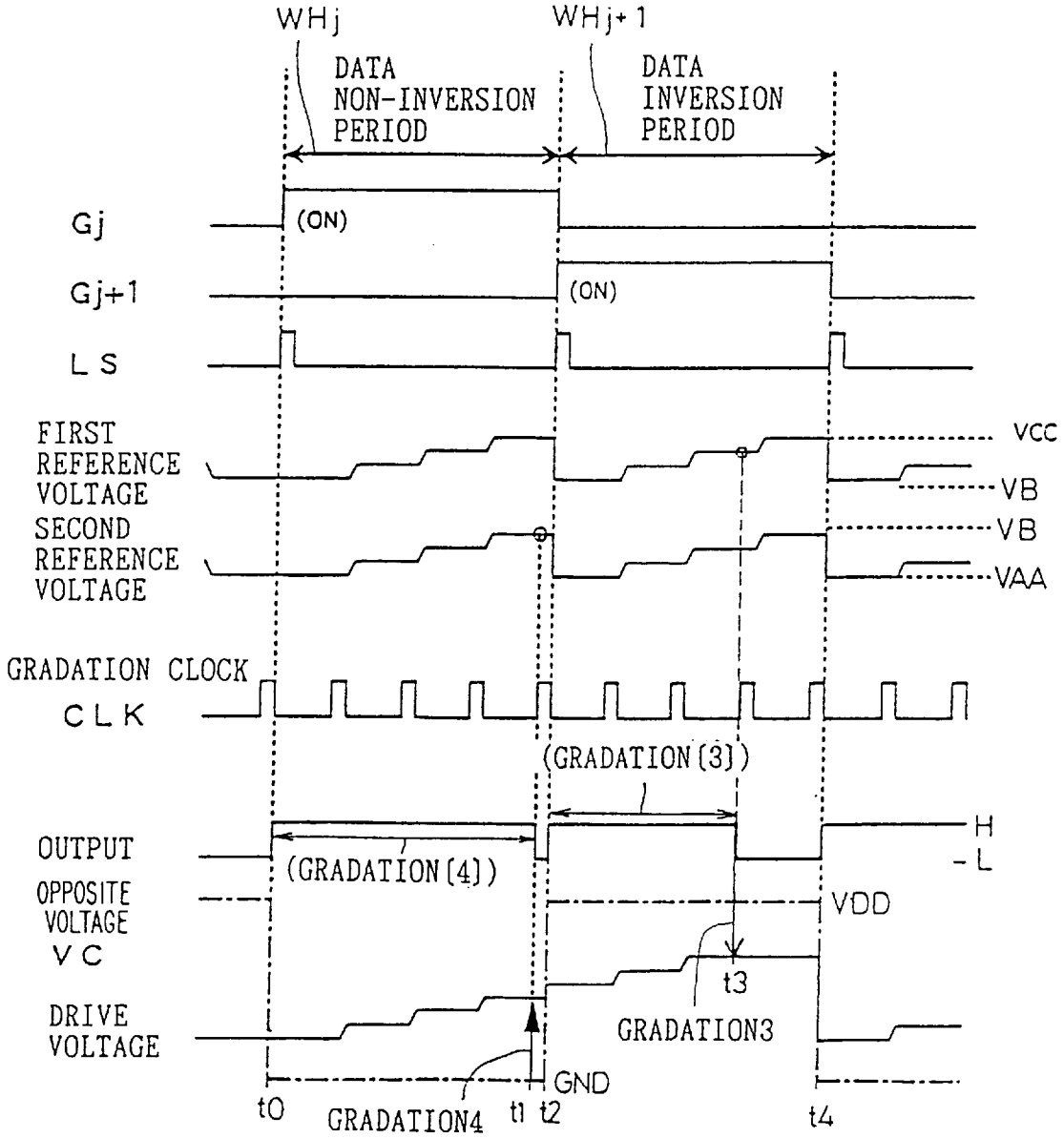
FIG. 10 is a timing chart illustrating the operation of the source driver 37.

The reference voltage source circuit 41 is provided to supply drive voltages to the source lines O1 to ON. The reference voltage source circuit 41 delivers first and second reference voltages having waveforms which rise stepwise with time via lines 42*a* and 42*b* as shown in FIG. 10. The periods of the voltages outputted from the reference voltage source circuit 41 are determined to be equal to a single horizontal scanning period WH.

Figure 2:
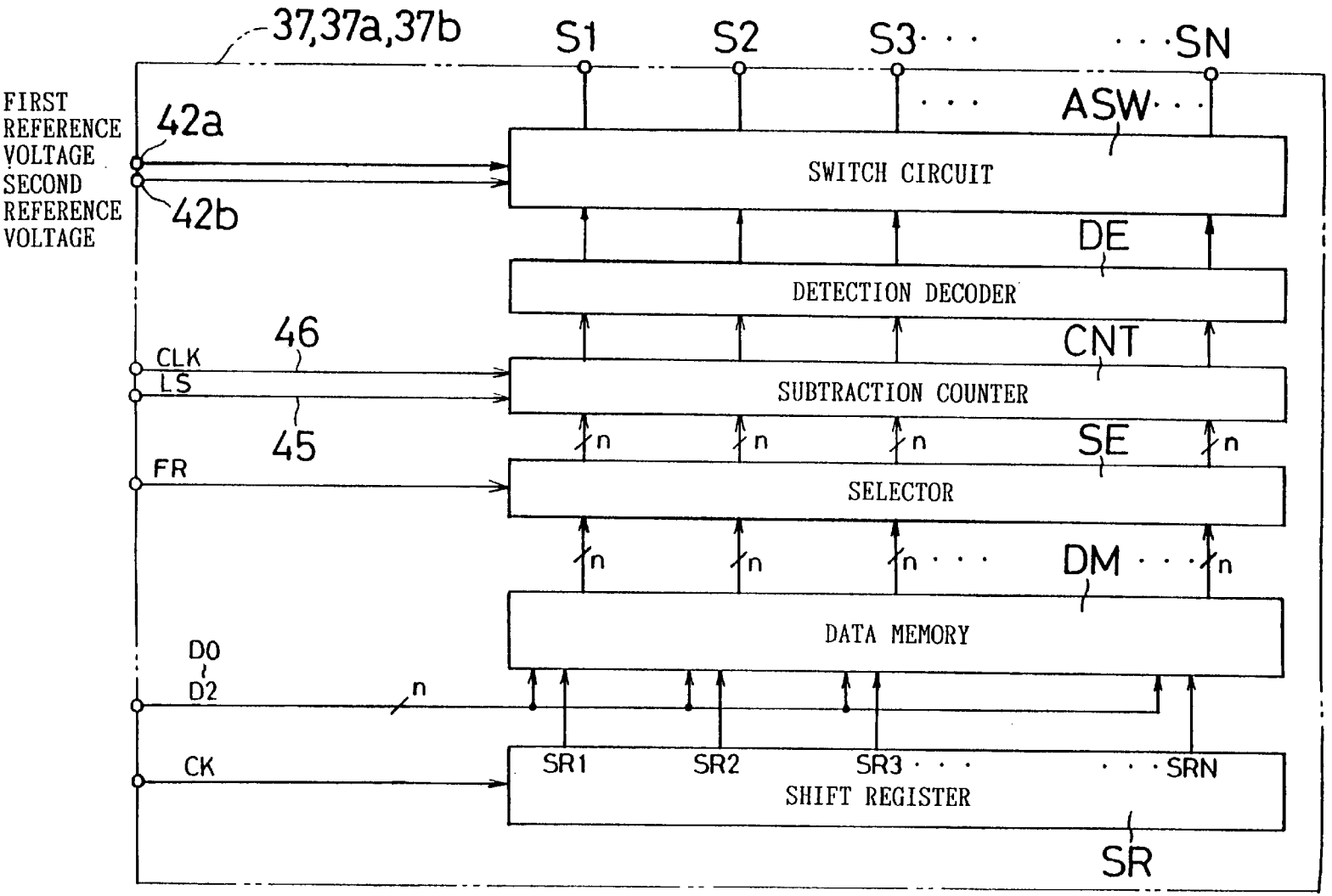
FIG. 2 is a block diagram showing a specific configuration of a source driver 37.
Figure 3:
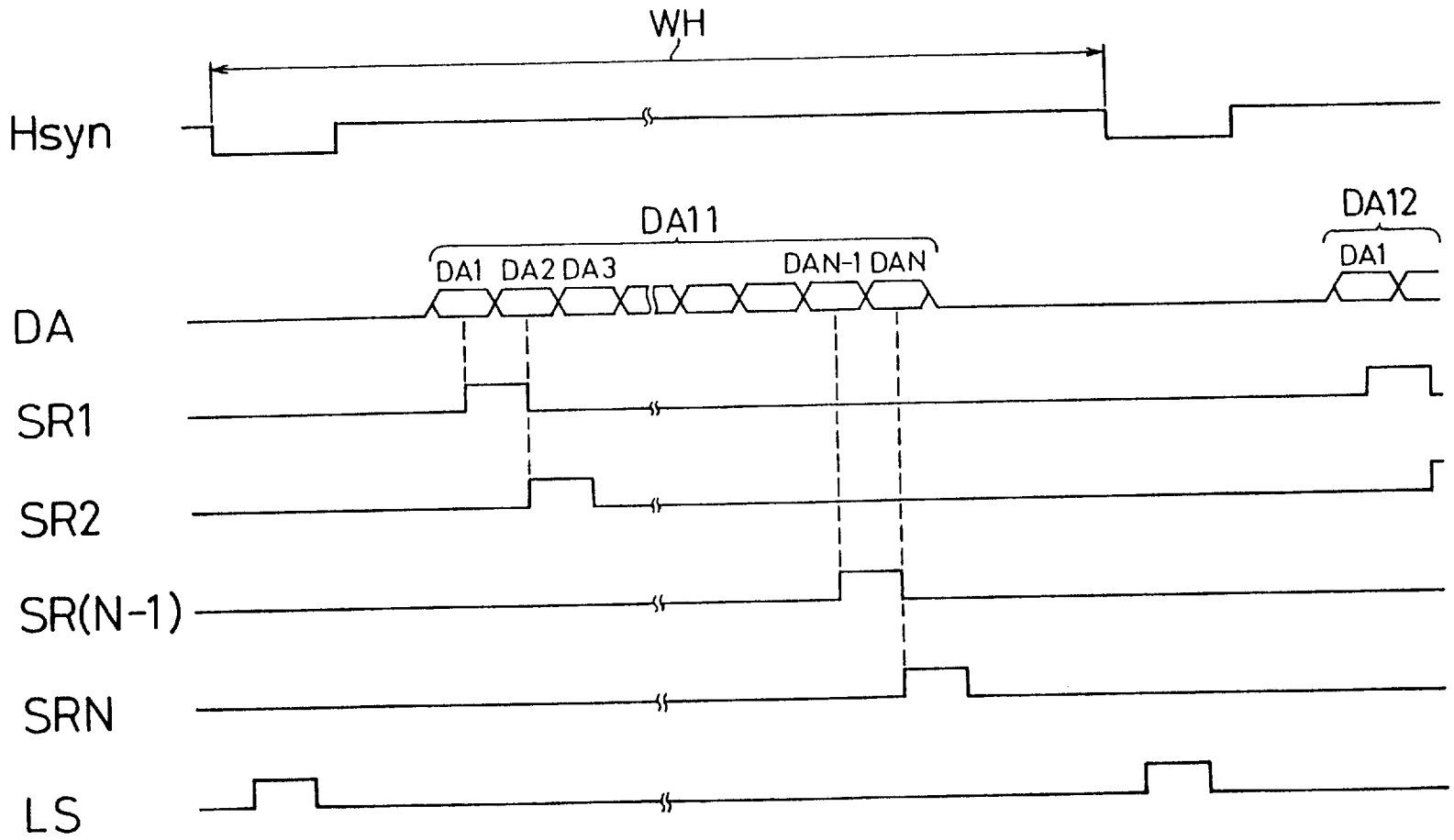
FIG. 3 is a waveform chart for illustrating the operation of the source driver 37 in a single horizontal scanning period WH.

FIG. 2 is a block diagram showing a specific configuration of the source driver 37, and FIG. 3 is a waveform chart illustrating the operation of the source driver 37 in a single horizontal scanning period WH. The source driver 37 comprises a shift register SR, a data memory DM, a selector SE, a subtraction counter CNT, a detection decoder DE and a switch circuit ASW. In FIG. 2, reference code n represents the number of lines. When gradation display data includes display data elements D0 to D2 for 3 bits, the value of n may be 3, for example.

The clock signal CK is supplied to the shift register SR sequentially. In accordance with the clock signal CK, the shift register SR sequentially delivers memory control signals SR1, SR2, . . ., SR (N-1) and SRN shown in FIG. 3 to each of the source lines O1 to ON. Serial 3-bit gradation display data elements D0, D1 and D2 supplied from the display control circuit 39 is supplied sequentially to the source driver 37 as the signals represented in FIG. 3 by reference codes DA1, DA2, DA3, . . ., DAN corresponding to the source lines O1 to ON respectively. The gradation display data elements D0 to D2 supplied to the source driver 37 is stored sequentially in the data memory DM in response to the memory control signals SR1 to SRN.

The AC-converting signal FR is supplied to the selector SE. Depending on the level of the AC-converting signal FR, the signal level of the gradation display data elements D0 to D2 is converted and supplied to the subtraction counter CNT. In response to the hold signal LS supplied via a line 45 at each horizontal scanning period WH shown in FIG. 3, the subtraction counter CNT stores and latches parallel 3-bit gradation display data elements D0 to D2 outputted from the selector SE in correspondence with all the source lines O1 to ON. The gradation clock signal CLK is also supplied to the subtraction counter CNT via a line 46. Until gradation clock signals CLK whose number is equal to the number of gradation levels represented by the gradation display data are inputted, the subtraction counter CNT outputs high level signals.

The detection decoder DE detects whether the output of the subtraction counter CNT is low in level. When the output of the subtraction counter (NT goes low, the detection decoder DE delivers a predetermined signal to the switch circuit ASW. The first and second reference voltages are supplied to the switch circuit ASW via lines 42*a*, 42*b*. Voltages corresponding to the gradation display data elements D0 to D2 are applied to the source lines O1 to ON via the connection terminals S1 to SN. The above-mentioned operations are performed in a single horizontal scanning period WH determined by a horizontal synchronizing signal Hsyn formed by the display control circuit 39 and shown in FIG. 3.

Figure 4:
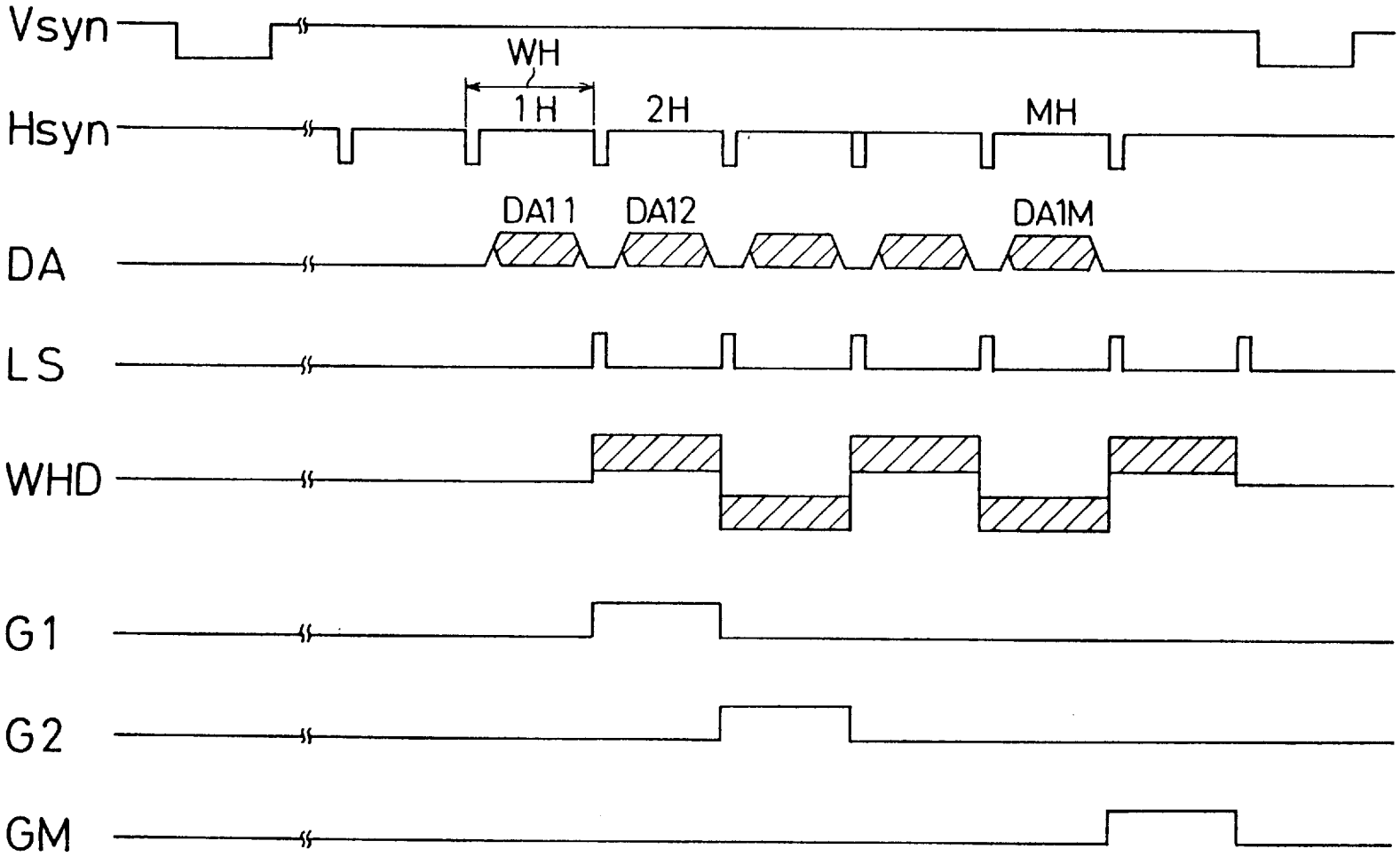
FIG. 4 is a waveform chart for illustrating the operation of a display control circuit 39.

FIG. 4 is a waveform chart illustrating the operation of the display control circuit 39. In each period of the vertical synchronizing signal Vsyn shown in FIG. 4, the horizontal synchronizing signal Hsyn shown in FIG. 4 is generated in correspondence with the gate lines L1 to LM.

The reference codes 1H, 2H, . . ., MH shown in FIG. 4 each represent a horizontal scanning period WH. The gradation display data signals DA1 to DAN corresponding to the source lines O1 to ON are generated in each horizontal scanning period WH from the display control circuit 39 as shown by DA11, DA12, . . ., DA1M in FIG. 4, and supplied to the source driver 37. In the signals shown in FIG. 4, each diagonally shaded area wholly represents the gradation display data element DA to be supplied to the N pieces of the source lines O1 to ON in total. FIG. 4 also shows the waveform of the hold signal LS generated in each horizontal scanning period WH.

The signal WHD shown in FIG. 4 wholly represents voltages to be supplied to the source lines O1 to ON in accordance with the gradation display data elements D0 to D2 to be supplied in a single horizontal scanning period WH. In the signal WHD shown in FIG. 4, each diagonally shaded area wholly represents voltages to be supplied to the N pieces of the source lines O1 to ON in total. In the non-interlaced display system, a single screen frame on the display panel 36 is displayed in a single vertical scanning period. The invention can also be applied even in the interlace system.

Furthermore, FIG. 4 shows the waveforms of gate signals G1, G2, . . ., GM to be supplied from the gate driver 38 to the gate lines L1, L2, . . ., LM. For example when the jth gate signal Gj is high, the N pieces of the thin film transistors T (j, i) (j=1 to M, i=1 to N) in total, the gate electrodes of which are connected to the gate line Lj, are all turned on. At this time, the pixel electrodes P (j, i) are charged depending on the drive voltages supplied to the source lines Oi. This operation is repeated M times in total for the gate lines L1 to LM so as to display a single screen frame in a single non-interlaced vertical scanning period. The polarity of the voltage supplied to each pixel electrode is inverted in each vertical scanning period for example by the so-called alternating drive method, thereby preventing the deterioration of the liquid crystals which will otherwise be deteriorated by the application of DC voltage for an extended period of time.

Figure 5:
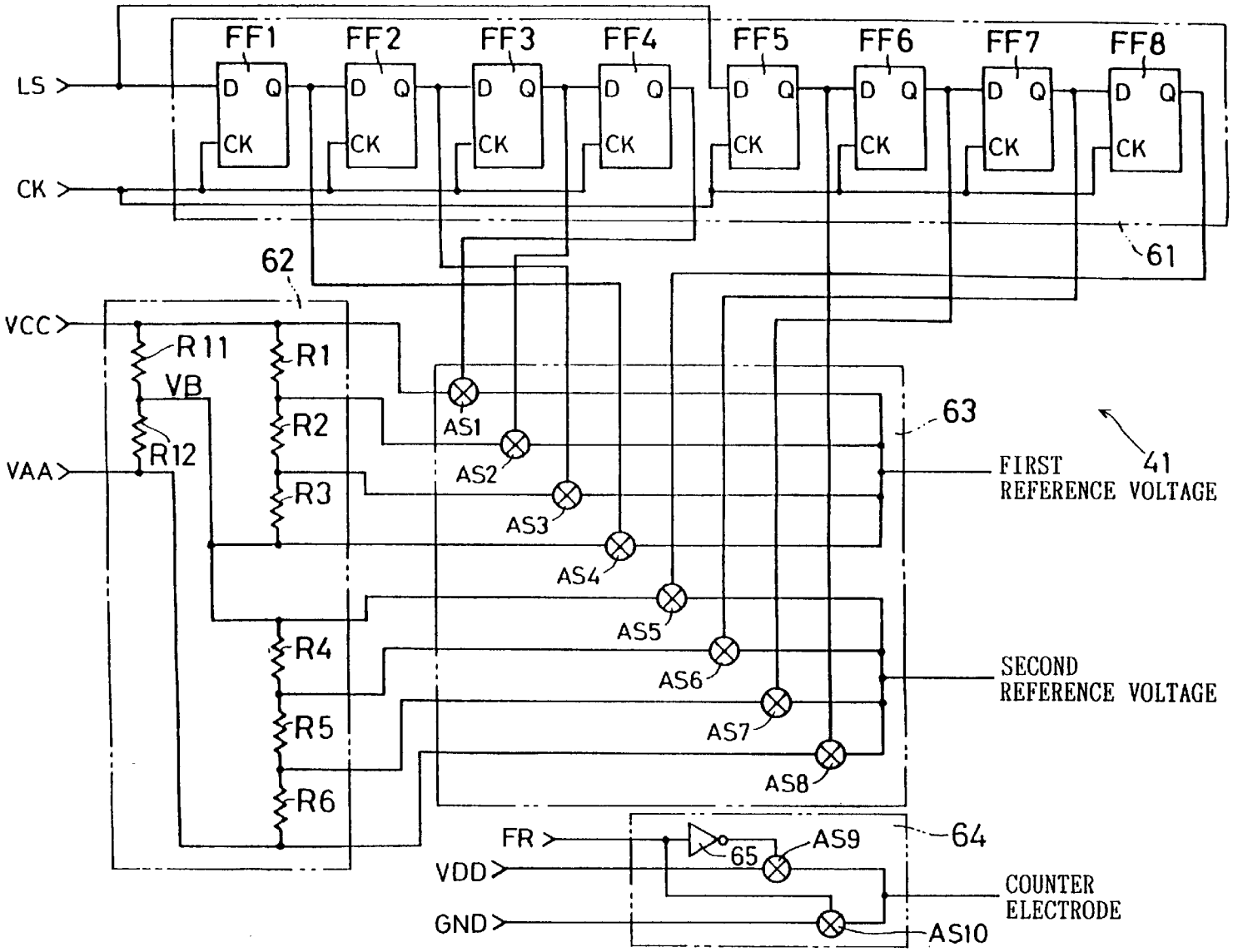
FIG. 5 is a circuit diagram showing the configuration of a reference voltage source circuit 41.

FIG. 5 is a circuit diagram showing the configuration of the reference voltage source circuit 41. For example, in this embodiment, the reference voltage source circuit 41 divides the voltages in the range from voltage VAA, which is defined to be higher than the ground voltage GND, to voltage VCC, into plural groups of reference voltages, for example, two parts of reference voltages to output every horizontal scanning period WH. More specifically, the reference voltage source circuit 41 generates voltage VB which is an intermediate voltage between the voltage VAA and the voltage VCC. As the first reference voltage used as the second voltage, the circuit 41 delivers, for example, a voltage changing stepwise from the voltage VB used as the second potential to the voltage VCC used as the third potential. In addition, as the second reference voltage used as the first voltage, the circuit 41 then delivers, for example, a voltage changing stepwise from the voltage VAA used as the first potential to the voltage VB used as the second potential.

Voltages GND and VDD as counter voltages mentioned below are alternatively selected in accordance with the level of the AC-converting signal FR and applied to the common electrode Q.

The reference voltage source circuit 41 comprises a timing control circuit 61, a voltage generating circuit 62, a voltage selection circuit 63 and a counter voltage supply circuit 64. The timing control circuit 61 comprises flipf-lops FF1 to FF4 and flip-flops FF5 to FF8. A clock signal CK is supplied commonly to the flip-flops FF1 to FF4 and flip-flops FF5 to FF8. The hold signal LS to be supplied to the flip-flops FF1 and FF5 are supplied sequentially to the corresponding subsequent flip-flops, for example, at each rise time of the clock signal CK. The outputs of the flip-flops FF1 to FF8 are supplied to the eight analog switches AS1 to AS8 of the voltage selection circuit 63 respectively in order to control the on/off operation of the analog switches AS1 to AS8. When the first reference voltage is changed stepwise from the voltage VB to the voltage VC for example, the output of the flip-flop FF1 controls the on/off operation of the analog switch AS4, the output of the flip-flop FF2 controls the on/off operation of the analog switch AS3, the output of the flip-flop FF3 controls the on/off operation of the analog switch AS2, and the output of the flip-flop FF4 controls the on/off operation of the analog switch AS1.

In addition, when the second reference voltage is changed stepwise from the voltage VAA to the voltage VB for example, the output of the flip-flop FF5 controls the on/off operation of the analog switch AS8, the output of the flip-flop FF6 controls the on/off operation of the analog switch AS7, the output of the flip-flop FF7 controls the on/off operation of the analog switch AS6, and the output of the flip-flop FF8 controls the on/off operation of the analog switch ASS. In the voltage selection circuit 63, the outputs of the analog switches AS1 to AS4 are connected in common and outputted as the first reference voltage, and the outputs of the analog switches AS5 to AS8 are also connected in common and outputted as the second reference voltage. By selectively supplying the outputs of the timing control circuit 61 to the analog switches AS1 to AS8, the voltage level change directions of the first and second reference voltages, that is, the rise/drop trends of the levels of the reference voltages with time can be determined. Alternatively, the change directions may be switched at intervals of plural horizontal scanning periods WH when the first and second reference voltages are outputted.

The voltage generating circuit 62 comprises resistors R1 to R6 and resistors R11 and R12. The resistors R1 to R6, R11 and R12 have predetermined resistance values. The resistors R11 and R12 are connected in series between the voltage VCC to the voltage VAA, and the voltage at the connection point of the resistors R11 and R12 is outputted as the voltage VB.

The resistors R1 to R3 are connected in series between the voltage VCC to the voltage VB. The voltage at one end of the resistor R1, namely the voltage VCC, is supplied to the analog switch AS1 of the voltage selection circuit 63. The voltage at the connection point between the other end of the resistor R1 and one end of the resistor R2 is supplied to the analog switch AS2, and the voltage at the connection point between the other end of the resistor R2 and one end of the resistor R3 is supplied to the analog switch AS3. The voltage at the other end of the resistor R3, namely the voltage VB, is supplied to the analog switch AS4.

The resistors R4 to R6 are connected in series between the voltage VB to the voltage VAA. The voltage at one end of the resistor R4, namely the voltage VB, is supplied to the analog switch ASS. The voltage at the connection point between the other end of the resistor R4 and one end of the resistor R5 is supplied to the analog switch AS6, and the voltage at the connection point between the other end of the resistor R5 and one end of the resistor R6 is supplied to the analog switch AS7. The voltage at the other end of the resistor R6, namely the voltage VAA, is supplied to the analog switch AS8.

The counter voltage supply circuit 64 comprises an inverter circuit 65, and analog switches AS9 and AS10. The inverter circuit 65, which is supplied with the AC-converting signal FR, inverts the level of the AC-converting signal FR to output.

The analog switch AS9 and analog switch AS10 are supplied with a voltage VDD and a voltage GND, respectively. The outputs from the analog switches AS9 and AS10 are supplied as counter voltages mentioned below to the common electrode Q.

On/off operations of the analog switch AS9 and the analog switch AS10 are controlled by outputs from the inverter 65 and the AC-converting signal FR, respectively. Consequently one of the analog switches AS9 and AS10 is conducted in relation to the level of the AC-converting signal FR, and the voltage which is supplied to the conducted analog switch is supplied as the counter voltage VC to the common electrode Q.

Figure 6B:
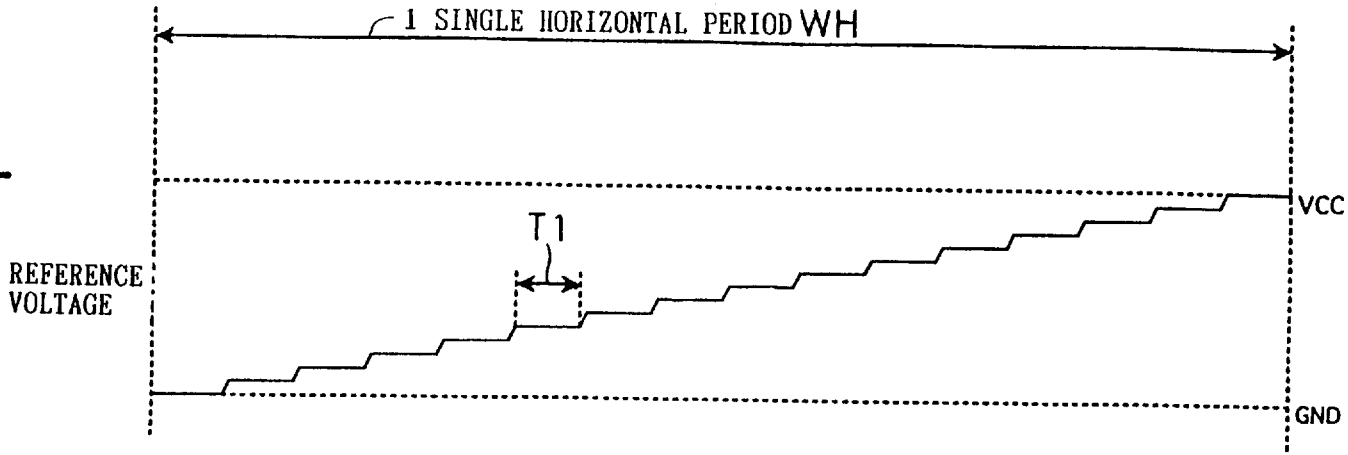
FIG. 6B is a waveform chart showing first and second reference voltages outputted from the reference voltage source circuit 41.
Figure 6B:
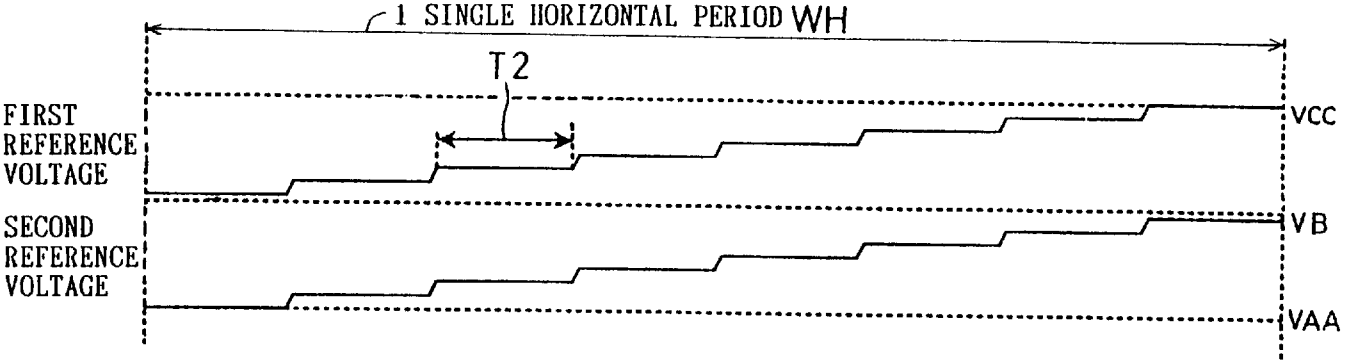

FIG. 6A is a waveform chart showing a reference voltage changing stepwise in a single horizontal scanning period WH. The reference voltage is divided into 16 steps in a single horizontal scanning period WH. A period T1 having a certain voltage level is 1/16 of the horizontal scanning period WH in length. FIG. 6B shows the waveforms of the first and second reference voltages outputted from the reference voltage source circuit 41. The first and second reference voltages are each divided into eight steps. The first or second reference voltage is supplied to the pixel electrodes P in accordance with the gradation display data elements D0 to D2. In the first and second reference voltages, a period T2 having a certain voltage level is 1/8 of the horizontal scanning period WH in length, two times as long as the period T1 in the waveform of the reference voltage shown in FIG. 6A. Consequently, more stabilized voltages can be applied at the time of voltage application to the pixel electrodes P. Even when the timing of the on/off control of the analog switches AS1 to AS8 is deviated from a predetermined timing, a desired voltage can be applied to the pixel electrodes P.

Figure 7:
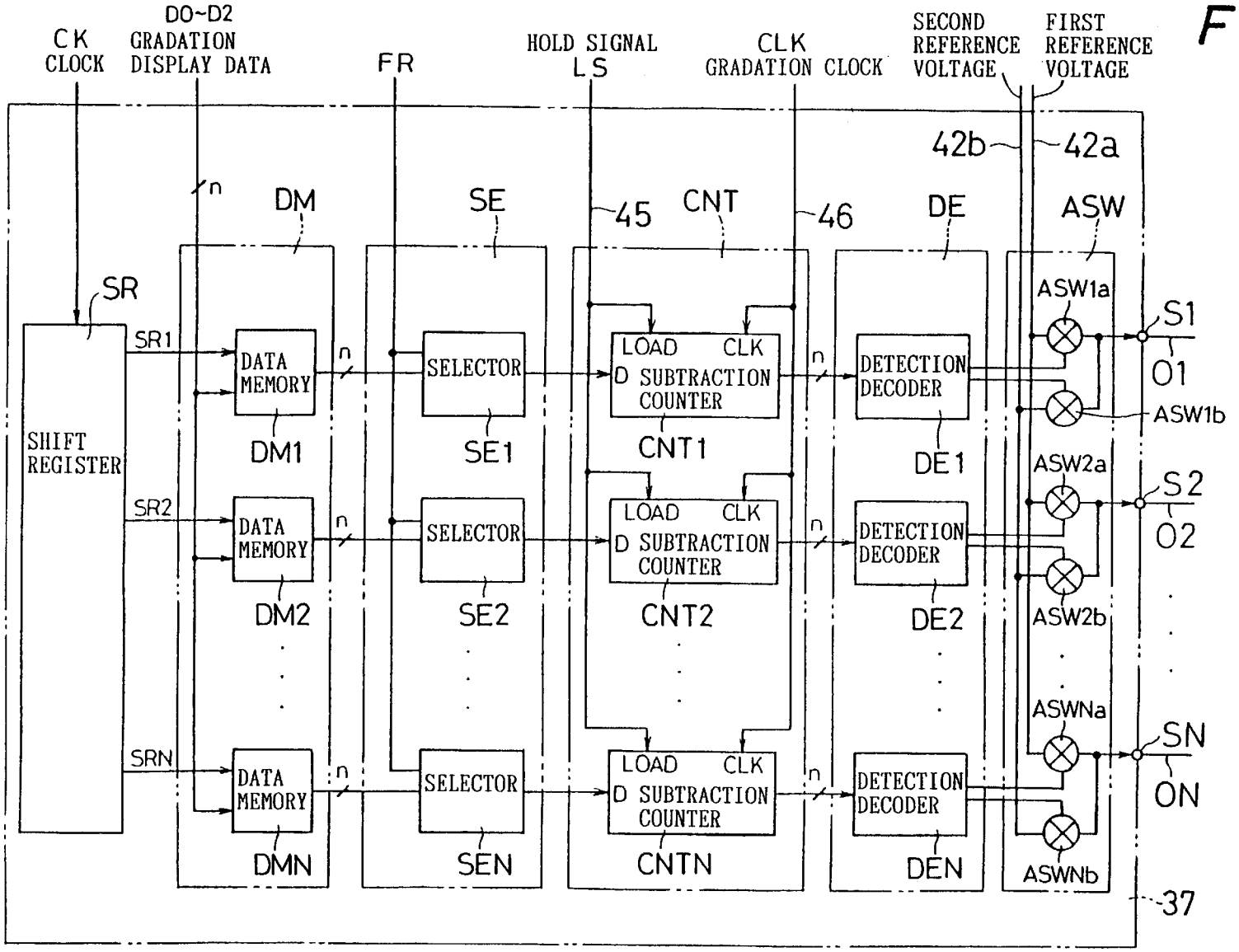
FIG. 7 is a block diagram showing a specific configuration for each source line Oi of the source drive 37.
Figure 8:
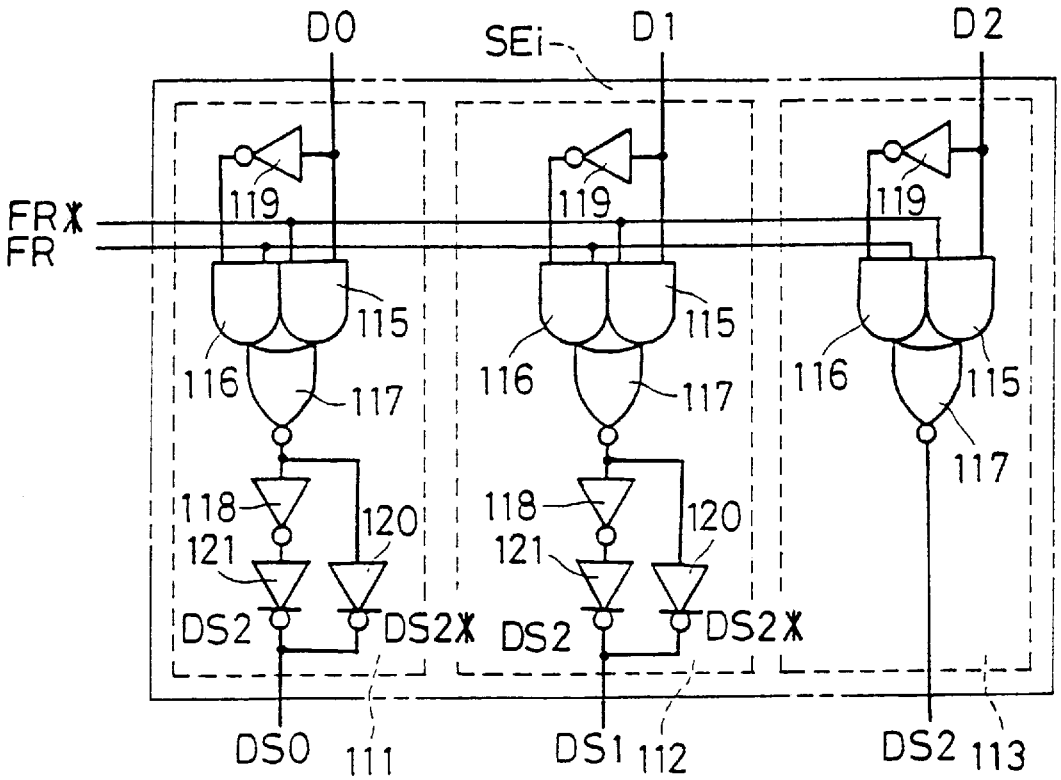
FIG. 8 is a circuit diagram showing a selector SEi.
Figure 9:
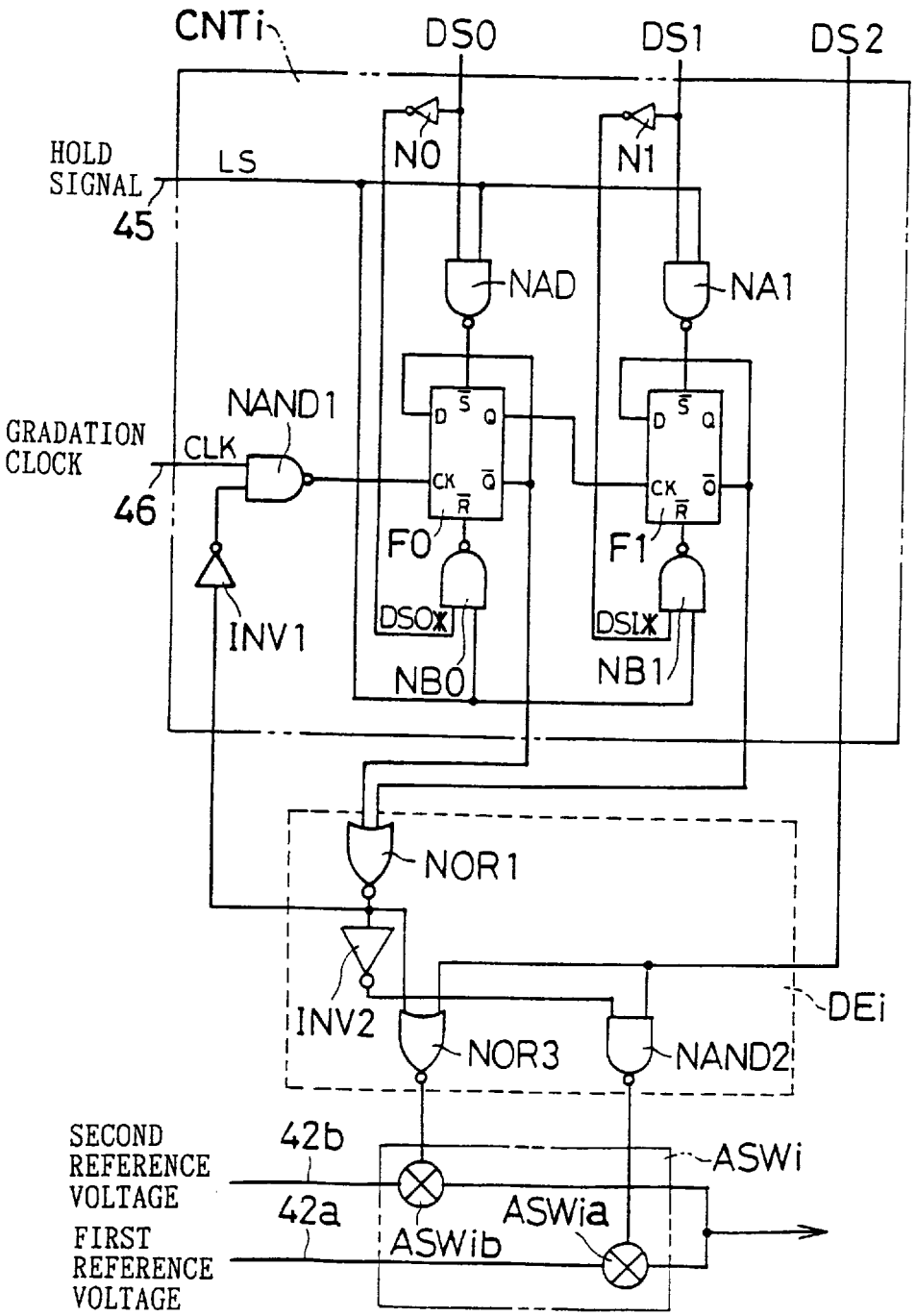
FIG. 9 is a circuit diagram showing specific configurations of a subtraction counter CNTi and a detection decoder DEi.

FIG. 7 is a block diagram showing a specific configuration for each source line Oi of the source driver 37. FIG. 8 is a circuit diagram of a selector SEi. FIG. 9 is a circuit diagram showing specific configurations of a subtraction counter CNTi and a detection decoder DEi.

First, the configurations of the selector SEi and the subtraction counter CNTi are described below. Referring to FIG. 8, the selector SEi comprises selector circuits 111, 112 and 113. The gradation display data element D0 is supplied to the selector circuit 111, the gradation display data element D1 is supplied to the selector circuit 112, and the gradation display data element D2 is supplied to the selector circuit 113. Although the selector SEi has a configuration supplied with 3-bit gradation display data elements D0 to D2, the selector can have a configuration supplied with n-bit gradation display data elements D0 to Dn-1. In this case, the gradation display data element Dn-1 of the most significant bit is supplied to the selector circuit 113, and the remaining gradation display data elements D0 to Dn-2 are supplied to circuits having the same configuration as that of the selector circuit 111.

Since the selector circuits 111 and 112 have the same configuration, the selector circuit 111 is described below as a representative example by assigning the same reference codes to the same components. The selector circuit 111 comprises AND circuits 115, 116, a NOR circuit 117, inverter circuits 118, 119 and clocked inverter circuits 120, 121.

The gradation display data element D0 is supplied to one input of the AND circuit 115, and a signal FR* (* represents inversion) obtained by inverting the AC-converting signal FR is supplied to the other input. Furthermore, the gradation display data element D0 is inverted by the inverter circuit 119 and supplied to one input of the AND circuit 116. The AC-converting signal FR is supplied to the other input of the AND circuit 116. The output of the AND circuit 115 is supplied to one input of the NOR circuit 117, and the output of the AND circuit 116 is supplied to the other output of the NOR circuit 117.

The output of the NOR circuit 117 is supplied to the inverter circuit 118 and the clocked inverter circuit 120.

The output of the clocked inverter circuit 121 supplied with the output of the inverter circuit 118 is connected to the output of the clocked inverter circuit 120 so as to deliver a gradation display data element DS0. The clocked inverter circuit 121 has been supplied with a gradation display data element DS2 described below, and is on/off-controlled in accordance with the level of the gradation display data element DS2. In addition, the clocked inverter circuit 120 has been supplied with a signal DS2* obtained by inverting the gradation display data element DS2, and is on/off-controlled in accordance with the level of the signal DS*. Consequently, the gradation display data element DS0 is outputted from one of the outputs of the clocked inverter circuits 120, 121 in accordance with the level of the signal DS2.

The selector circuit 113 comprises AND circuits 115, 116, a NOR circuit 117 and an inverter circuit 119. In the selector 113, the output of the NOR circuit 117 delivers the gradation display data element DS2. The level of the gradation display data element DS2 is inverted by an inverter circuit (not shown) to generate the inverted signal DS2*.

Referring to FIG. 9, the subtraction counter CNTi comprises inverter circuits N0, Ni and INV1; NAND circuits NA0, NA1, NB0, NB1 and NAND1; and flip-flops F0 and F1. Among the parallel 3-bit gradation display data elements DS0 to DS2 supplied from the selector circuit SEi, the gradation display data elements DS0, DS1 are supplied to one input terminal of the NAND circuit NA0 and one input terminal of the NAND circuit NA1 respectively. The other input terminals of the NAND circuits NA0, NA1 are supplied with the hold signal LS via the line 45. The outputs of the NAND circuits NA0, NA1 are supplied respectively to the set input terminals S* of the D-type flip-flops F0, F1 with RS (reset, set). The inverter circuits N0, N1 invert the levels of the gradation display data elements DS0, DS1 and signals DS0*, DS1* respectively. The signals DS0*, DS1* are supplied to one input terminal of the NAND circuit NB0 and to one input terminal of the NAND circuit NB1, respectively, and the other input terminals of the NAND circuits NB0, NB1 are supplied with the hold signal LS via the line 45. The outputs of the NAND circuits NB0, NB1 are supplied respectively to the reset input terminals R* of the flip-flops F0, F1.

The outputs Q* of the flip-flops F0, F1 are supplied respectively to the input terminals D of the flip-flops F0, F1. The clock input terminal CK of the first stage flip-flop F0 is supplied with the output of the NAND circuit NAND1. One of the inputs of the NAND circuit NAND1 is supplied with the gradation clock signal CLK via the line 46. The output of the NOR circuit NOR1 described later is inverted by the inverter circuit INV1, and supplied to the other input of the NAND circuit NAND1. The clock input terminal CK of the flip-flop F1 is supplied with the output Q of the flip-flop F0.

The detection decoder DEi comprises NOR circuits NOR1, NOR3; a NAND circuit NAND2; and an inverter circuit INV2. The NOR circuit NOR1 is supplied with the outputs Q* of the flip-flops F0, F1. The output of the NOR circuit NOR1 is supplied to the inverter INV1 provided in the above-mentioned subtraction counter CNTi, and also supplied to the inverter INV2.

The output of the inverter INV2 is supplied to one input of the NAND circuit NAND2. The other input of the NAND circuit NAND2 is supplied with the gradation display data element DS2. One input of the NOR circuit NOR3 is supplied with the output of the NOR circuit NOR1, and the other input is supplied with gradation display data element DS2.

The output of the NAND circuit NAND2 controls the on/off operation of the analog switch ASWia having been supplied with the first reference voltage, and the output of the NOR circuit NOR3 controls the on/off operation of the analog switch ASWib having been supplied with the second reference voltage. The switch circuit ASWI comprises analog switches ASWia, ASWib, each of which is turned on when the level of the signal to be supplied is high.

When the analog switch ASWia or ASWib is turned on, the first or second reference voltage supplied to the line 42*a* or 42*b* is applied to the corresponding source line Oi via the connection terminal Si to be supplied to the pixel electrodes P and then held.

Referring to FIG. 7 again, the operation of the source driver 37 is described below. The data memory DMi corresponding to the ith source line Oi (i=1 to N) samples and stores the serial 3-bit gradation display data elements D0 to D2 when a memory control signal SRi is supplied from the shift register SR. The data stored in the data memory DMi is supplied to the selector SEi.

In the switch circuit ASW, the analog switches ASW1a, ASW1b; ASW2*a*, ASW2*b*; . . .; ASWNa, ASWNb, used as switching devices for voltage application, are disposed between the lines 42*a*, 42*b* supplied with the first and second reference voltages from the reference voltage source circuit 41 and the source lines O1 to ON respectively.

Furthermore, the source driver 37 shown in FIG. 7 is configured so as to be externally supplied with the gradation clock signal CLK. However, by providing a circuit generating the gradation clock signal CLK in the source driver 37, the number of the signal input terminals for the source driver 37 can be reduced by one.

The operation of the subtraction counter CNTi is described below. When the hold signal LS is supplied to the subtraction counter CNTi, the gradation display data elements DS0, DS1 are loaded respectively to the flip-flops F0, F1 from the selector SEi. The gradation display data loaded to the flip-flops F0, F1 are subtracted sequentially in response to the gradation clock signal CLK. When all the outputs Q of the flip-flops F0, F1 constituting the subtraction counter CNTI go to logical "0" this state is by the detection decoder DEi.

Until a signal is supplied from the detection decoder DEi, the first or second reference voltage has been outputted from the output terminal Si to the source line Oi. When a signal is supplied from the detection decoder DEi the analog switch ASWi is turned off, and the impedance viewed from the output terminal Si to the source driver 37 goes high.

The output of the NOR circuit NOR1 is supplied to the NAND gate NAND1 via the inverter circuit INV1. When the output of the inverter circuit INV1 goes low, the gradation clock signal CLK is not supplied to the first stage flip-flop F0. As a result, the subtraction counter CNTi stops its subtraction counting operation, and this state is held until the hold signal LS is supplied again.

FIG. 10 is a timing chart illustrating the operation of the source driver 37. When a gate signal Gj shown in FIG. 10 is supplied to a gate line Lj (j=1 to M), the transistor T, the gage electrode of which is connected to the gate line Lj, is turned on in the horizontal scanning period WHj from time t0 to time t2 wherein the gate signal Gj is at high level. The voltages supplied to the source lines O1 to ON are supplied to the pixel electrodes P via the transistor T which is turned on. In addition, in the horizontal scanning period WHj+1 from time t2 to time t4, the gate signal Gj+1 is high. The period WHj is a data non-inversion period, and the period WHj+1 is a data inversion period. Table 1 lists the gradation display data elements D0 to D2 in the non-inversion and inversion periods for each gradation level. In the present embodiment, the display data elements D0 to D2 are directly output in the data non-inversion period. In the inversion period, all the bits are inverted and outputted.

TABLE 1

| Gradation | Non-inversion period | | | Inversion period | | |
|---|---|---|---|---|---|---|
| level | D0 | D1 | D2 | D0 | D1 | D2 |
| 1 | 0 | 0 | 0 | 1 | 1 | 1 |
| 2 | 1 | 0 | 0 | 0 | 1 | 1 |
| 3 | 0 | 1 | 0 | 1 | 0 | 1 |
| 4 | 1 | 1 | 0 | 0 | 0 | 1 |
| 5 | 0 | 0 | 1 | 1 | 1 | 0 |
| 6 | 1 | 0 | 1 | 0 | 1 | 0 |
| 7 | 0 | 1 | 1 | 1 | 0 | 0 |
| 8 | 1 | 1 | 1 | 0 | 0 | 0 |

The hold signal LS shown in FIG. 10 is generated in synchronization with the horizontal synchronizing signal Hsyn. The display control circuit 39 supplies the synchronizing signal via the line 49 (see FIG. 1), whereby the reference voltage source circuit 41 delivers the first reference voltage shown in FIG. 10 to the line 42*a* and also delivers the second reference voltage shown in FIG. 10 to the line 42*b* after time t0.

In a single horizontal scanning period WH, the gradation clock signals CLK, the number of which is ½ or more of the number of gradation levels represented by the gradation display data, are delivered sequentially with time. In the present embodiment, when eight-level gradation display is performed by using gradation display data elements of 3 bits, for example, four gradation clock signals CLK are generated in each horizontal scanning period WH. The number of the gradation clock signals CLK generated in the horizontal scanning period WH may be more than four. The first or second reference voltage is applied to the source line Oi in accordance with the logical value of the gradation display data element D2. In other words, in the data non-inversion period, when the gradation display data element D2 is logical "0", the second reference voltage is applied; when the data element D2 is logical "1", the first reference voltage is applied. Furthermore, in the data inversion period, when the gradation display data element D2 is logical "0" the first reference voltage is applied; when the data element D2 is logical "1", the second reference voltage is applied.

When a gradation display to be displayed in the period WHj is assumed to have four gradation levels, the output signal from the detection decoder DEi shown in FIG. 10 remains high until time t1 wherein the fourth gradation clock signal CLK rises in the period WHj, and the analog switch ASWib is turned on, and the second reference voltage is supplied from the connection terminal Si to the source line Oi. The output signal in the period WHj is the output of the NOR circuit NOR3. In the period from time t0 to time ti, the second reference voltage is directly applied to the source line Oi as shown by the drive voltage in FIG. 10.

Since the analog switch ASWi is turned off as described above after time t1, the driver voltage corresponding to a number of gradation levels of four remains supplied to the pixel electrodes P, and charges are stored at the pixel display portions of the display panel, thereby holding the voltage corresponding to the charges. The opposite voltage VC applied to the common electrode Q is a voltage lower than VAA, such as the ground voltage GND, in the data non-inversion period WHj from time t0 to time t2.

When it is assumed that alternating drive is performed at the source driver 37 in each horizontal scanning period WH, the opposite voltage VC outputted from the reference voltage source circuit 41 is a voltage higher than VCC, such as the voltage VDD, in the data inversion period WHj+1 from time t2 to time t4. When it is assumed that the number of gradation levels represented by the gradation display data is 3 in the horizontal scanning period WHj+1 from time t2 to time t4, the output signal goes high from time t2 to time t3, and the analog switch ASWia is turned on. The output of the NAND circuit NAND2 is used as the output signal in the period WHj+1. The analog switch ASWia remains turned on until the output signal goes low at time t3.

Since the analog switch ASWia is turned on between time t2 and time t3, the first reference voltage is delivered to the source line Oi as the drive voltage from the line 42*a* via the analog switch ASWia and the connection terminal Si. The drive voltage corresponding to a number of gradation levels of three is supplied to the pixel electrodes P via the transistors T which are turned on, and then held.

The above-mentioned operation is repeated for the gate lines L1 to LM in each horizontal scanning period WH. The drive voltage corresponding to the gradation display data for the pixel electrode P is held in a single vertical scanning period.

Figure 11:
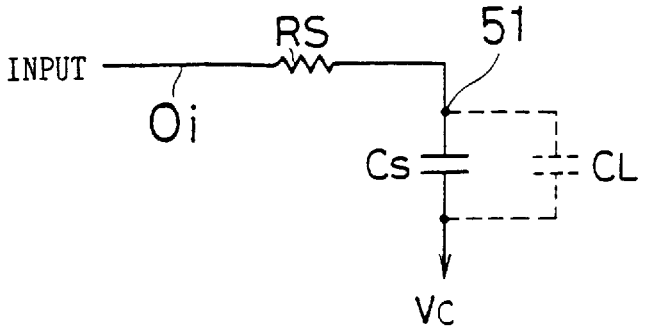
FIG. 11 is an equivalent circuit diagram which schematically shows a liquid crystal display panel 36 to illustrate the principle of the invention.

FIG. 11 is an equivalent circuit, diagram which schematically shows a liquid crystal display panel 36 to illustrate the principle of the invention. The invention offers a circuit having the so-called low-pass filter function, wherein the resistor RS of the single source line Oi, which is an object of driving by the source driver 37, is connected to the electrostatic capacitance Cs of the source line Oi in series.

The equivalent capacitance of the pixel electrode P is represented by reference code CL. The electrostatic capacitance CL of the pixel electrode P is sufficiently smaller than the capacitance Cs of the source line Oi (Cs>>CL). Accordingly, the voltage supplied to the pixel electrode P is equal to the voltage at the connection point 51 of the resistor Rs and the electrostatic capacitance Cs. Therefore, in this equivalent circuit having the low-pass filter function shown in FIG. 11, a reference voltage is supplied to the source line Oi via the analog switch ASWi to charge the pixel electrode P. When the time constant $Cs \cdot RS = {}^{10-7}$, the on period of the analog switch ASWi should be at least 20 t0 30 μsec.

As described above, the invention positively utilizes the resistance RS and the electrostatic capacitance Cs of the source line Oi inherent in the liquid crystal display panel 36 so as to allow the pixel electrode P to hold the voltage. In another embodiment of the invention, an auxiliary capacitance may be formed between the source line Oi and a gate line L(j-1) to be scanned one line ahead of the gate line Lj connected to the gate electrode of the transistor T on the substrate on which the pixel electrode P is formed, thereby substantially increasing the capacitance for holding the voltage at the pixel electrode P.

Figure 12:
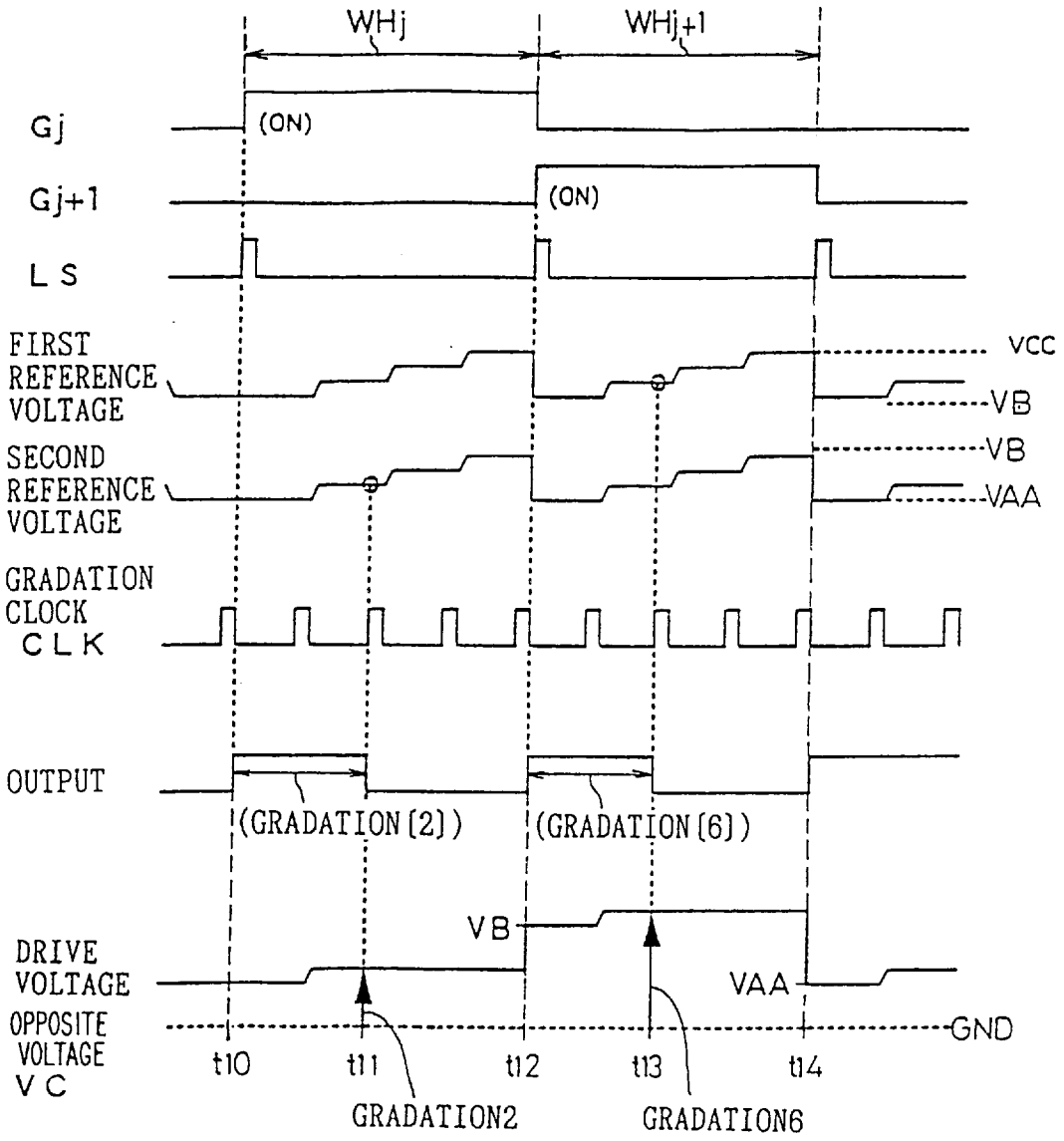
FIG. 12 is a timing chart illustrating the operation of a source driver 37*a* of a display apparatus 100*a* having another configuration of the first embodiment.

FIG. 12 is a timing chart illustrating the operation of the source driver 37*a* of the display apparatus 100*a* of another configuration of the embodiment. Since the configuration of the source driver 37*a* is the same as that of the above-mentioned source driver 37, the same reference codes are used for explanation. Accordingly, the configuration is not explained here. Although alternating is performed in each horizontal scanning period WH in the source driver 37, alternating is performed in each plural horizontal scanning period WH in the source driver 37*a*. Accordingly, the opposite voltage VC is the ground voltage GND, from example, in the horizontal scanning periods WHj, WHj+1 shown in FIG. 12.

In the signals shown in the timing chart of FIG. 12, the gate signals Gj, Gj+1, the hold signal LS, the first reference voltage, the second reference voltage and the gradation clock signal CLK are not explained here since they are the same as those shown in FIG. 10. It is assumed that in the horizontal scanning period WHj from time t10 to time t12 in FIG. 12, two-level gradation display is performed, and that in the horizontal scanning period WHj+1 from time t12 to time t14, six-level gradation display is performed.

Until time t11 wherein the gradation clock signal CLK rises at the second time, the output signal remains high, thereby turning on the analog switch ASWib. The output signal in the period WHj is the output of the NOR circuit NOR3. When the analog switch ASWib is turned on, the drive voltage has the same waveform as that of the second reference voltage in the period from time t10 to time t11. After time till wherein the analog switch ASWib is turned off, the voltage at time t11 is held.

Since the number of gradation levels is 6 in the horizontal scanning period WHj+1, the analog switch ASWia is turned on, the first reference voltage is outputted until time t13, and the voltage at time t13 is held until time t14. The output signal in the period WHj+1 is the output of the NAND circuit NAND2.

Figure 13A:
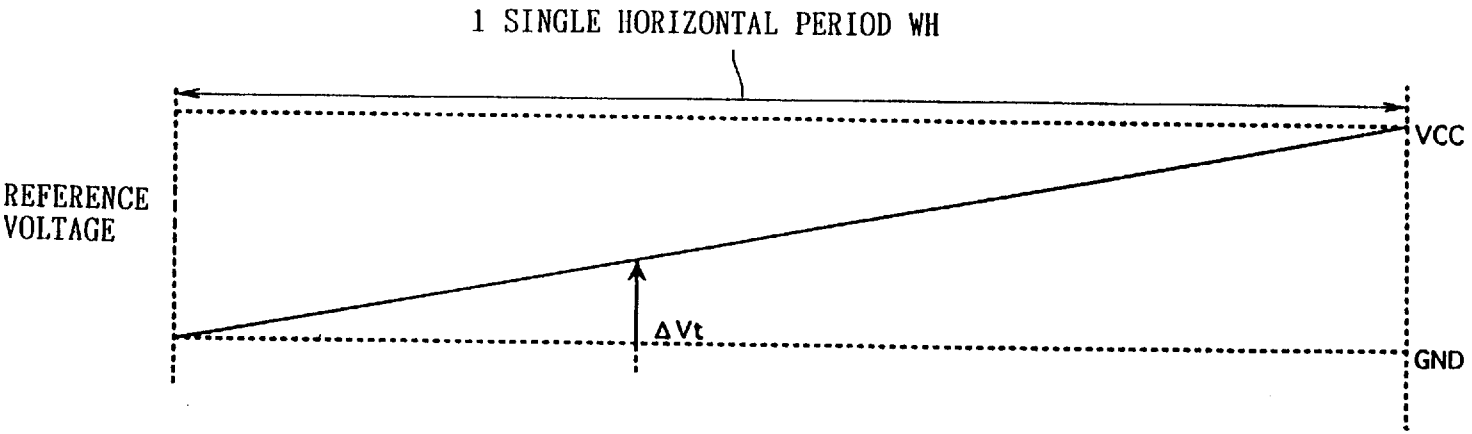
FIG.13A PRIOR ART
FIG. 13A is a waveform chart showing a reference voltage changing linearly in a single horizontal scanning period WH.
Figure 13B:
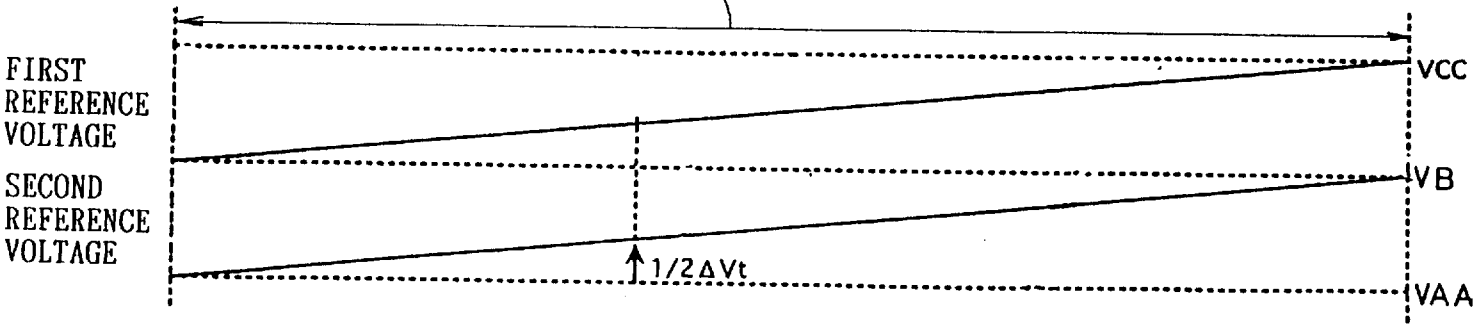
FIG. 13B is a chart illustrating voltages outputted from a reference voltage source circuit 41*b* of a display apparatus 100*b* having still another configuration of the first embodiment.

FIG. 13A is a waveform chart showing a reference voltage changing linearly from the voltage VAA to the voltage VCC in a single horizontal scanning period WH. In addition, FIG. 13B is a waveform chart showing the first and second reference voltages outputted from the reference voltage source circuit 41*b* of the display apparatus 100*b* of still another configuration of the embodiment. In the horizontal scanning period WH, the first reference voltage changes linearly from the voltage VB to the voltage VCC, and the second reference voltage changes linearly from the voltage VAA to the voltage VB. Either the first or second reference voltage is supplied to the pixel electrode P depending on the gradation display data elements D0 to D2.

The ranges of change in the first and second reference voltages in a single horizontal scanning period are smaller than that of the reference voltage shown in FIG. 13A.

Therefore, even when the timing values for controlling the analog switches ASWia, ASWib are deviated from a predetermined timing value, the deviation of the voltage, actually applied to the line Oi, from a desired voltage can be reduced.

Figure 14:
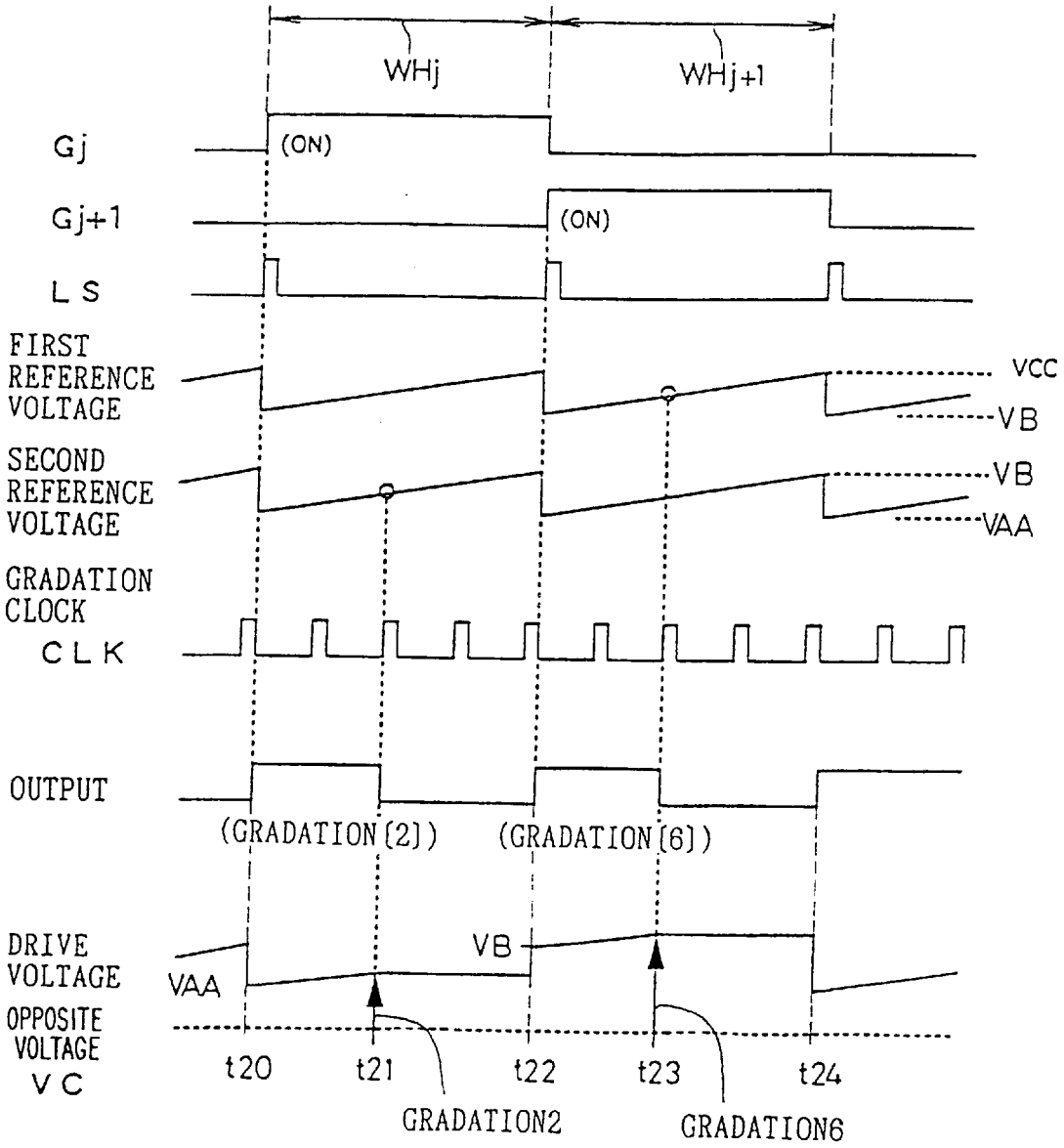
FIG. 14 is a timing chart illustrating the operation of a source driver 37*b* of the display apparatus 100*b*.

FIG. 14 is a timing chart showing the operation of the source driver 37*b* of the display apparatus 100*b*. In FIG. 14, the gate signals Gj, Gj+1, the hold signal LS, the gradation clock signal CLK are not explained here since they are the same as those shown in FIG. 10. In the horizontal scanning period WHj from time t20 to time t22 shown in FIG. 14, two-level gradation display is performed, and in the horizontal scanning period WHj+1 from time t22 to time t24, six-level gradation display is performed. The first reference voltage shown in FIG. 14 changes linearly from the voltage VB to the voltage VCC, and the second reference voltage shown in FIG. 14 changes linearly from the voltage VAA to the voltage VB.

Until time t21 wherein the gradation clock signal CLK rises at the second time, the output signal shown in FIG. 14 from the detection decoder goes high, thereby turning on the analog switch ASWib. The output signal in the period WHj is the output of the NOR circuit NOR3. When the analog switch ASWib is turned on, the drive voltage shown in FIG. 14 has the same waveform as that of the second reference voltage in the period from time t20 to time t21. After time t21 wherein the analog switch ASWib is turned off, the voltage at time t21 is held.

Since the number of gradation levels is six in the period WHj+1, the analog switch ASWia is turned on, the drive voltage at time t22 is the voltage VB. The output signal in the period WHj+1 is the output of the NAND circuit NAND2. Just as the first reference voltage, the drive voltage increases linearly in the period from time t22 to time t23, and after time t23, the voltage at time t23 is held until time t24.

Figure 15:
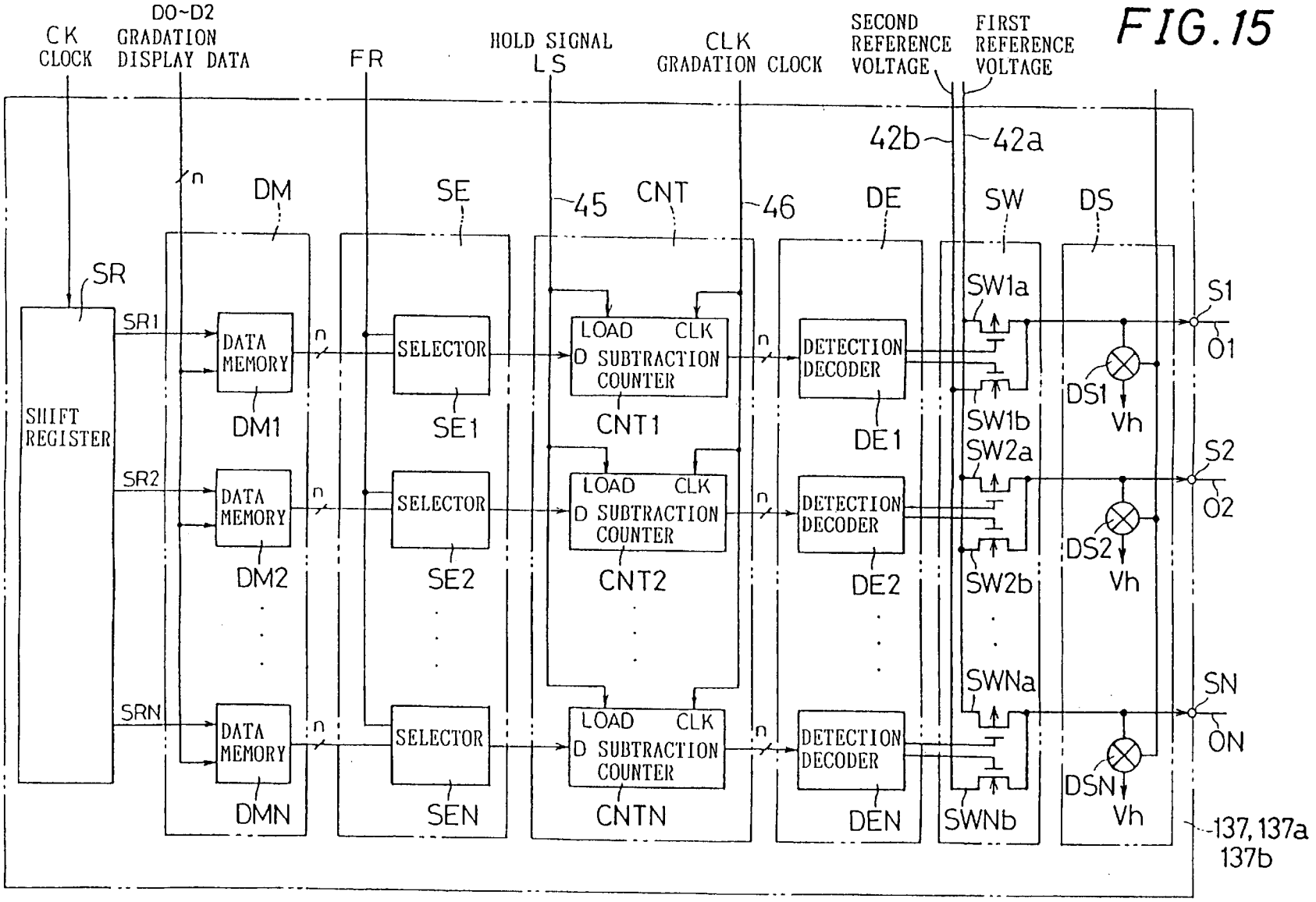
FIG. 15 is a block diagram illustrating the configuration of the source driver 137 of a display apparatus 100*c* of a second embodiment of the invention.
Figure 16:
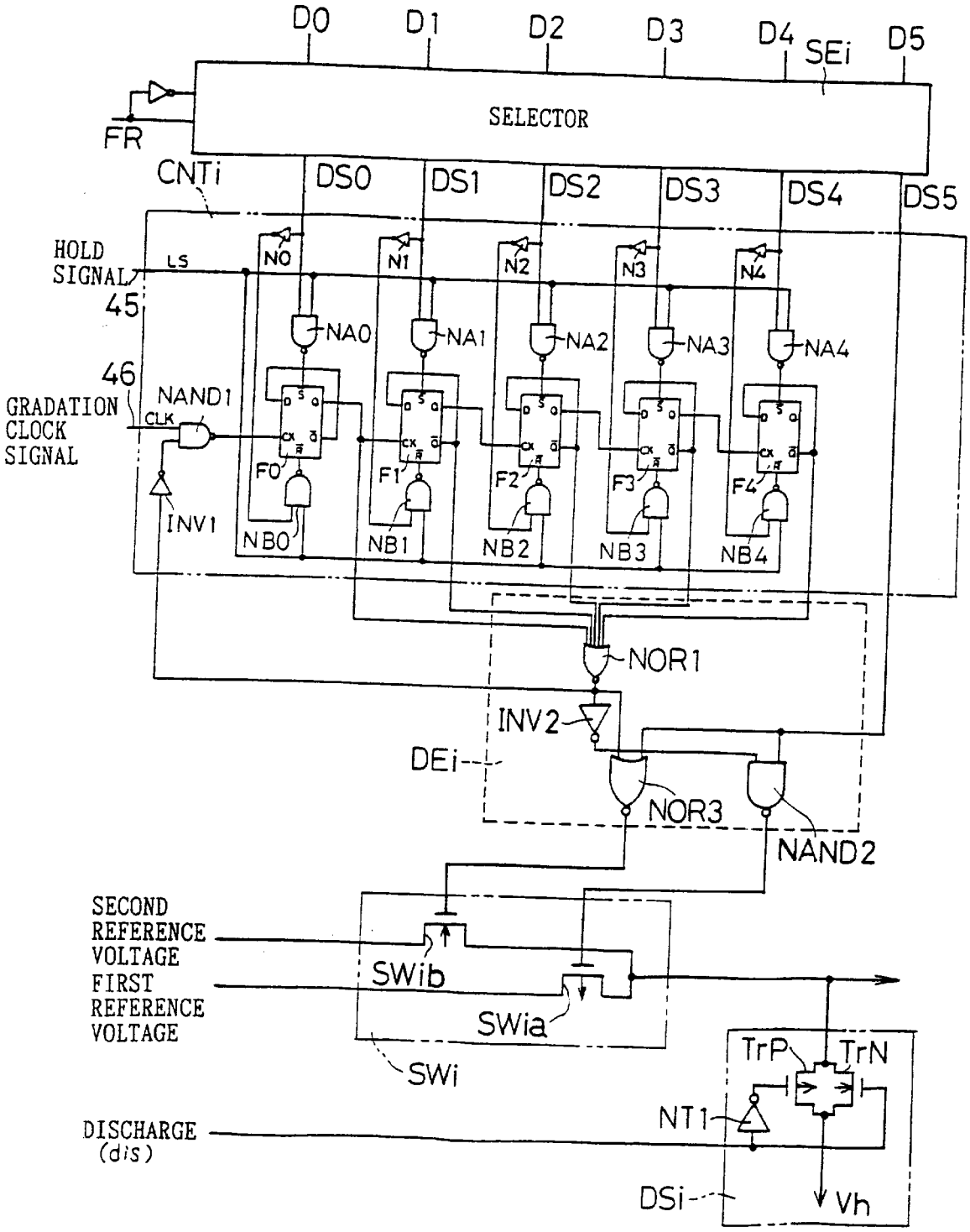
FIG. 16 is a circuit diagram illustrating part of the source driver 137.

FIG. 15 is a block diagram illustrating the configuration of the source driver 137 of the display apparatus 100*c* in accordance with a second configuration of the embodiment of the invention, and FIG. 16 is a circuit diagram showing part of the source driver 137. The same components of the source driver 137 as those of the above-mentioned source driver 37 are represented by the same reference codes and not explained here.

The source driver 137 has features in that a switch circuit SW is provided in place with the analog switch circuit ASW, and that a discharge circuit DS is provided.

The switch circuit SW comprises P-channel transistors SW1*a*, SW2*a*, . . ., SWNa supplied with the first reference voltage, and N-channel transistors SW1*b*, SW2*b*, . . ., SWNb supplied with the second reference voltage. The P-channel transistor SWia and the N-channel transistor SWib are used as a pair, and the outputs of the detection decoder DEi is supplied to the gates of the transistors. The output of the P-channel transistor SWia and the output of the N-channel transistor SWib are connected to each other, and further connected to the terminal Si via the discharge circuit DS.

The discharge circuit DS comprises analog switches DS1, DS2, . . ., DSN. The input terminal of the analog switch DSi is connected between the switch circuit SWi and the terminal Si, and the output terminal is connected to a predetermined voltage Vh, whereby the on/off operation of the analog switch DSi is controlled by using a discharge signal dis described below.

The two analog switches for controlling the outputs, namely the first and second reference voltages, in the above-mentioned source driver 37 are implemented by using the P-channel transistor SWia and the N-channel transistor SWib in the source driver 137. Therefore, the area of the source driver 137 can be made smaller than that of the source driver 37. However, the P-channel transistors SWia can raise the potential thereof but cannot lower the potential, the N-channel transistors SWib can lower the potential thereof but cannot raise the potential.

Therefore, discharge by using the discharge circuit DSi is necessary. Furthermore, since the voltage Vh is determined to be the voltage VB as described below in the embodiment, the first reference voltage to be supplied to the P-channel transistor SWia is required to be a voltage which rises from the voltage VB to the voltage VCC, and the second reference voltage to be supplied to the N-channel transistor SWib is required to be a voltage which drops from the voltage VB to the voltage VAA.

Referring to FIG. 16, the operations of the switch circuit SWi and the discharge circuit DSi are described below. In FIG. 16, six gradation display data elements D0 to D5 are supplied to the selector SEi. Although the most significant bit in the selector SEi and the subtraction counter CNTi shown in FIGS. 8 and 9 is the gradation display data element D2, the most significant bit in the selector SEi and the subtraction counter CNTi shown in FIG. 16 is the gradation display data element D5.

The NAND circuit NAND2 of the detection decoder DEi drives the P-channel transistor SWia when the most significant bit, namely the gradation display data element DS5 is high. When the output of the NOR circuit NOR1 is low, the NAND circuit NAND2 turn on the transistor SWia so that the first reference voltage is outputted via the transistor SWia. When the output of the NOR circuit NOR1 goes high, the NAND circuit NAND2 delivers a high level voltage and the transistor SWia is turned off. When the transistor SWia is turned off, outputs of the output terminal go to a high impedance state.

In addition, when the gradation display data element DS5 is low, the NOR circuit NOR3 drives the N-channel transistor SWib. When the output of the NOR circuit NOR1 is low, the NOR circuit NOR3 turns on the transistor SWib so that the second reference voltage is outputted via the transistor SWib. When the output of the NOR circuit NOR1 goes high, the output of the NOR circuit NOR3 goes low and the transistor SWib is turned off. When the transistor SWib is turned off, outputs of the output terminal go to a high impedance state.

The discharge circuit DSi comprises a P-channel transistor TrP, an N-channel transistor TrN and an inverter circuit NT1. The source of the transistor TrP is connected to the drain of the transistor TrN, and the output of the switch circuit SWi is supplied to the connection point. In addition, the drain of the transistor TrP is connected to the source of the transistor TrN, and a predetermined voltage Vh is supplied to the connection point. A discharge signal dis is supplied to the gate of the transistor TrN, and a signal obtained by inverting the discharge signal dis using the inverter circuit NT1 is supplied to the gate of the transistor TrP. Accordingly, when the discharge signal dis goes high, the transistors TrN, TrP are turned on, and the voltage Vh is supplied to the terminal Si. In the following description of the embodiment, the voltage Vh is represented by the voltage VB.

Figure 17:
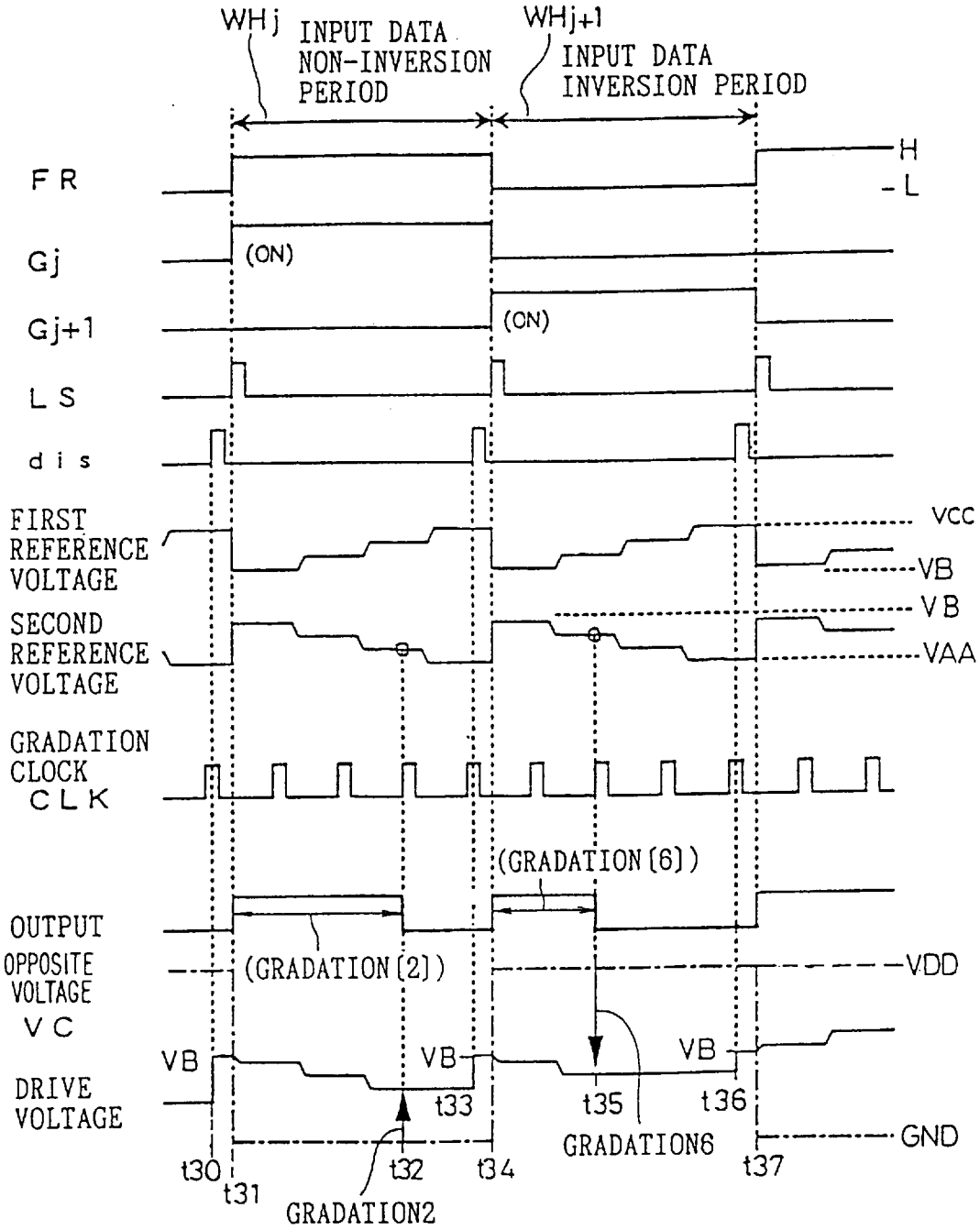
FIG. 17 is a timing chart illustrating the operation of the source driver 137.

FIG. 17 shows a timing chart illustrating the operation of the source driver 137. Since the gate signals Gj, Gj+1, the hold signal LS, the gradation clock signal CLK and the opposite voltage VC shown in FIG. 17 are the same as those shown in FIG. 10 respectively, these signals are not described here. FIG. 17 shows an AC-converting signal FR for determining the period of the above-mentioned alternate drive. In the period WHj from time t31 to time t34, during which the AC-converting signal FR is high, the gradation display data is not inverted by the selector SEi. In the period WHj+1 from time t34 to time t37, the gradation display data is inverted by the selector SEi. Table 2 shows the gradation display data elements D0 to D2, the gradation display data elements DS0*a* to DS2*a* outputted from the selector SEi in the inversion period, and the gradation display data elements DS0*b* to DS2*b* outputted from the selector SEi in the non-inversion period.

TABLE 2

| Gradation | Display data | | | Inversion period FR = L | | | Non-inversion period FR = H | | |
|---|---|---|---|---|---|---|---|---|---|
| level | D2 | D1 | D0 | DS2a | DS1a | DS0a | DS2b | DS1b | DS0b |
| 1 | 0 | 0 | 0 | 1 | 1 | 1 | 0 | 1 | 1 |
| 2 | 0 | 0 | 1 | 1 | 1 | 0 | 0 | 1 | 0 |
| 3 | 0 | 1 | 0 | 1 | 0 | 1 | 0 | 0 | 1 |
| 4 | 0 | 1 | 1 | 1 | 0 | 0 | 0 | 0 | 0 |
| 5 | 1 | 0 | 0 | 0 | 0 | 0 | 1 | 0 | 0 |
| 6 | 1 | 0 | 1 | 0 | 0 | 1 | 1 | 0 | 1 |
| 7 | 1 | 1 | 0 | 0 | 1 | 0 | 1 | 1 | 0 |
| 8 | 1 | 1 | 1 | 0 | 1 | 1 | 1 | 1 | 1 |

When 8-step gradation display is performed in the liquid crystal display apparatus 100*c*, in the non-inversion period, the voltages corresponding to numbers of gradation levels of five, six, seven and eight are outputted as the first reference voltage to be selected when the most significant bit, namely the gradation display data element D2, is high, and the voltages corresponding to numbers of gradation levels of four, three, two and one are outputted as the second reference voltage to be selected when the gradation display data element D2 is low.

Furthermore, in the inversion period, the voltages corresponding to numbers of gradation levels of four, three, two and one are outputted as the first reference voltage to be selected when the gradation display data element D2 is high, and the voltages corresponding to numbers of gradation levels of eight, seven, six and five are outputted as the second reference voltage to be selected when the gradation display data element D2 is low.

Before the hold signal LS rises at time t31, the discharge signal dis rises at time t30, and the drive voltage shown in FIG. 17 is equal to the voltage VB determined as the voltage Vh.

When the gradation display in the period WHj is performed in accordance with a number of gradation levels of two, the output signal from the detection decoder DEi shown in FIG. 17 is high until time t32 when the third gradation clock signal CLK rises in the period WHj. Accordingly, the transistor SWib is turned on, and the second reference voltage is supplied from the connection terminal Si to the source line Oi. More specifically, since the gradation display data element DS2*b* is logical "0" at the time of display in accordance with number 2 of gradation levels in the non-inversion period, the output of the NOR circuit NOR3 is raised high by the output of the above-mentioned NOR circuit NOR1, and the transistor SWib is turned on. Furthermore, while the output of the NOR circuit NOR3 is high, the output of the NAND circuit NAND2 goes high, and the transistor SWib is off. The output signal in the period WHj is the output of the NOR circuit NOR3.

In the period from time t31 to time t32, the second reference voltage is supplied directly to the source line Oi as a drive voltage. Since the transistor SWib is turned off after time t32 as described above, the drive voltage corresponding to a number of gradation levels of two remains supplied to the pixel electrodes P, and charges are stored at the pixel electrodes of the display panel, thereby holding the voltage. At time t33 between the time of fourth rise of the clock signal CLK in the period WHj and time t34 wherein the period WHj ends, the discharge signal dis rises, the transistors TrP, TrN are turned on, and the drive voltage reaches the voltage VB.

When it is assumed that gradation display is performed in accordance with number 6 of gradation levels in the horizontal scanning period WHj+1 between time t34 and time t37, the output signal is high in the period from time t34 to time t35, and the transistor SWib is turned on. The logic of the gradation display data element DS2*a* during display in accordance with number 6 of gradation levels in the inversion period is the same as the logic of the gradation display data element DS2*b* during the above-mentioned non-inversion period. The output of the NOR circuit NOR3 is also the same as that of the output of the NAND circuit NAND2. The output signal during the period WHj+1 is the output of the NOR circuit NOR3.

At time t35, the transistor SWib remains turned on until the output signal goes low. Since the transistor SWib is on in the period from time t34 to time t35, the second reference voltage is delivered to the source line Oi as the drive voltage. Even after the transistor SWib is turned off at time t35, the drive voltage corresponding to a number of gradation levels of six is held at the pixel electrodes P via the transistors T which are turned on. When the discharge signal dis rises at time t36, discharge occurs and the held voltage reaches the voltage VB.

The above-mentioned operation is repeated at the gate lines L1 to LM in each horizontal scanning period WH, and the drive voltage corresponding to the gradation display data at the pixel electrodes P is held in a single vertical scanning period.

Figure 18:
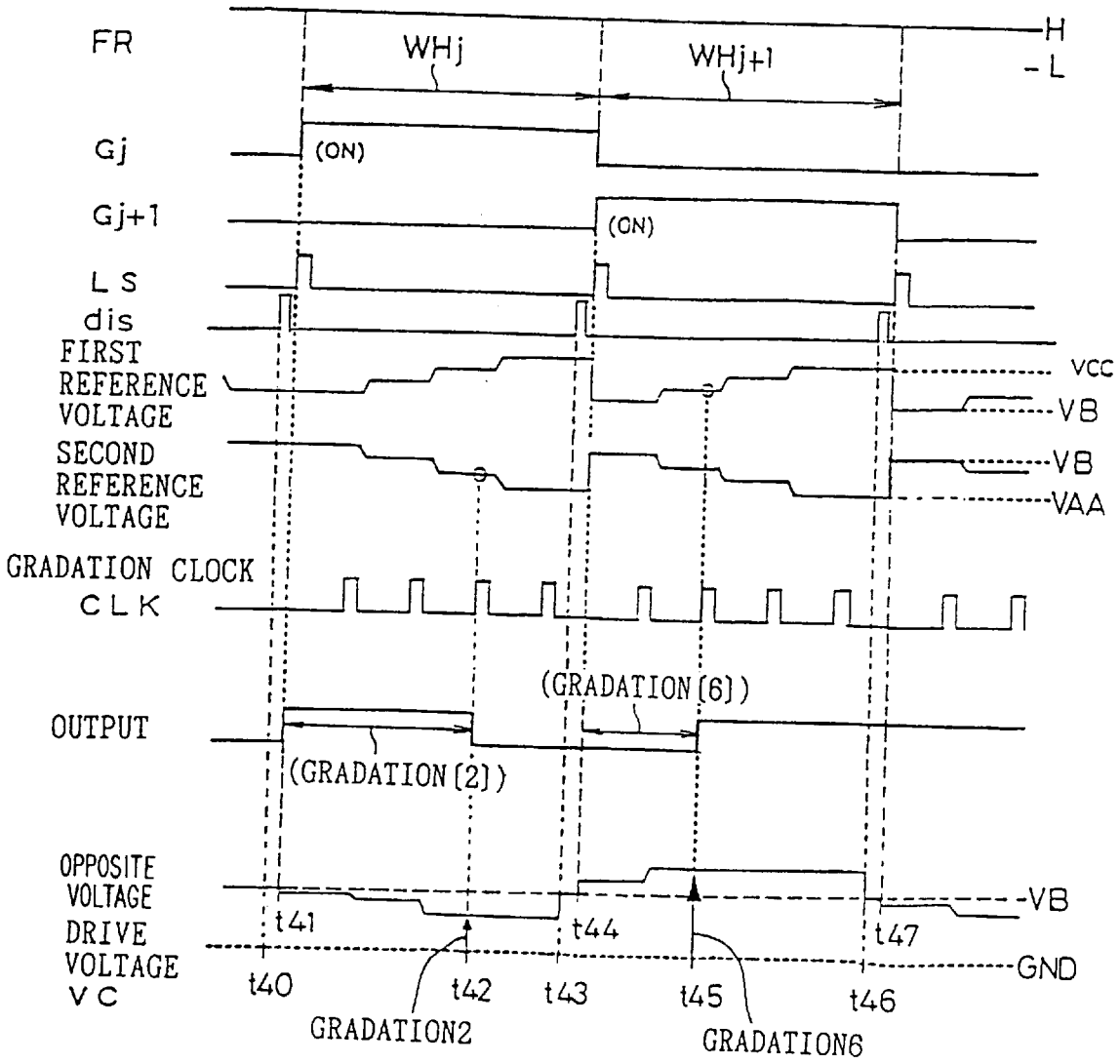
FIG. 18 is a timing chart illustrating the operation of the source driver 137*a* of a display apparatus 100*d* having another configuration of the second embodiment.

FIG. 18 is a timing chart illustrating the operation of the source driver 137*a* in a display apparatus 100*d* having another configuration of the embodiment. Since the gate signals Gj, Gj+1, the hold signal LS, the discharge signal dis, the first reference voltage, the second reference voltage and the gradation clock signal CLK shown in FIG. 18 are the same as those shown in FIG. 17 respectively, these signals are not described here. In the source driver 137, alternate drive is performed by switching the AC-converting signal FR in each horizontal scanning period WH. However, in the source driver 137*a*, alternate drive is performed in each predetermined plurality of horizontal scanning periods WH. The AC-converting signal FR shown in FIG. 18 remains high in the period from time t40 to time t47. In the timing chart shown in FIG. 18, it is assumed that display is performed in accordance with number 2 of gradation levels in the period WHj, and that in the period WHj+1, display is performed in accordance with number 6 of gradation levels. Since the AC-converting signal FR is high at all times, the gradation display data elements DS0*c* to DS2*c* outputted from the selector SEi are shown in Table 3.

TABLE 3

| Gradation level | Display data D2 | D1 | D0 | Non-inversion period DS2c | DS1c | DS0c |
|---|---|---|---|---|---|---|
| 1 | 0 | 0 | 0 | 0 | 1 | 1 |
| 2 | 0 | 0 | 1 | 0 | 1 | 0 |
| 3 | 0 | 1 | 0 | 0 | 0 | 1 |
| 4 | 0 | 1 | 1 | 0 | 0 | 0 |
| 5 | 1 | 0 | 0 | 1 | 0 | 0 |
| 6 | 1 | 0 | 1 | 1 | 0 | 1 |
| 7 | 1 | 1 | 0 | 1 | 1 | 0 |
| 8 | 1 | 1 | 1 | 1 | 1 | 1 |

Since the AC-converting signal FR is high at all times, the first reference voltage shown in FIG. 18 is the voltage corresponding to numbers of gradation levels of five, six, seven and eight, and the second reference voltage is the voltage corresponding to numbers of gradation levels of four, three, two and one. The output signal shown in FIG. 18 is high until time t42 wherein the gradation clock signal CLK rises at the third time, and the transistor SWib supplied with the second reference voltage is turned on.

The output signal in the period WHj is the output of the NOR circuit NOR3.

When the transistor SWib is turned on, the drive voltage shown in FIG. 18 has the same waveform as that of the second reference voltage in the period from time t41 to time t42. After time t42 wherein the transistor SWib is turned off, the voltage at time t42 is held. When the discharge signal dis rises at time t43, the transistors TrP, TrN are turned on, and the drive voltage reaches the voltage VB.

Since the number of the gradation levels is 6 in the period WHj+1, the output signal is low in the period from time t44 to time t45, the transistor SWia is turned on, the first reference voltage is outputted, and the voltage at time t45 is held until time t46 wherein the discharge signal dis rises. More specifically, since the logic of the gradation display data element DS2*b* during display in accordance with the number of gradation levels of six in the non-inversion period is "1" the output of the NAND circuit NAND2 goes low owing to the output of the inverter circuit INV2 obtained by inverting the output of the NOR circuit NOR1, and the transistor SWia is turned on. In addition, while the output of the NAND circuit NAND2 is low, the output of the NOR circuit NOR3 is also low, and the transistor SWib is turned off. The output signal in the period WHj+1 is the output of the NAND circuit NAND2. When the discharge signal dis rises, the drive voltage reaches the voltage VB.

Figure 19:
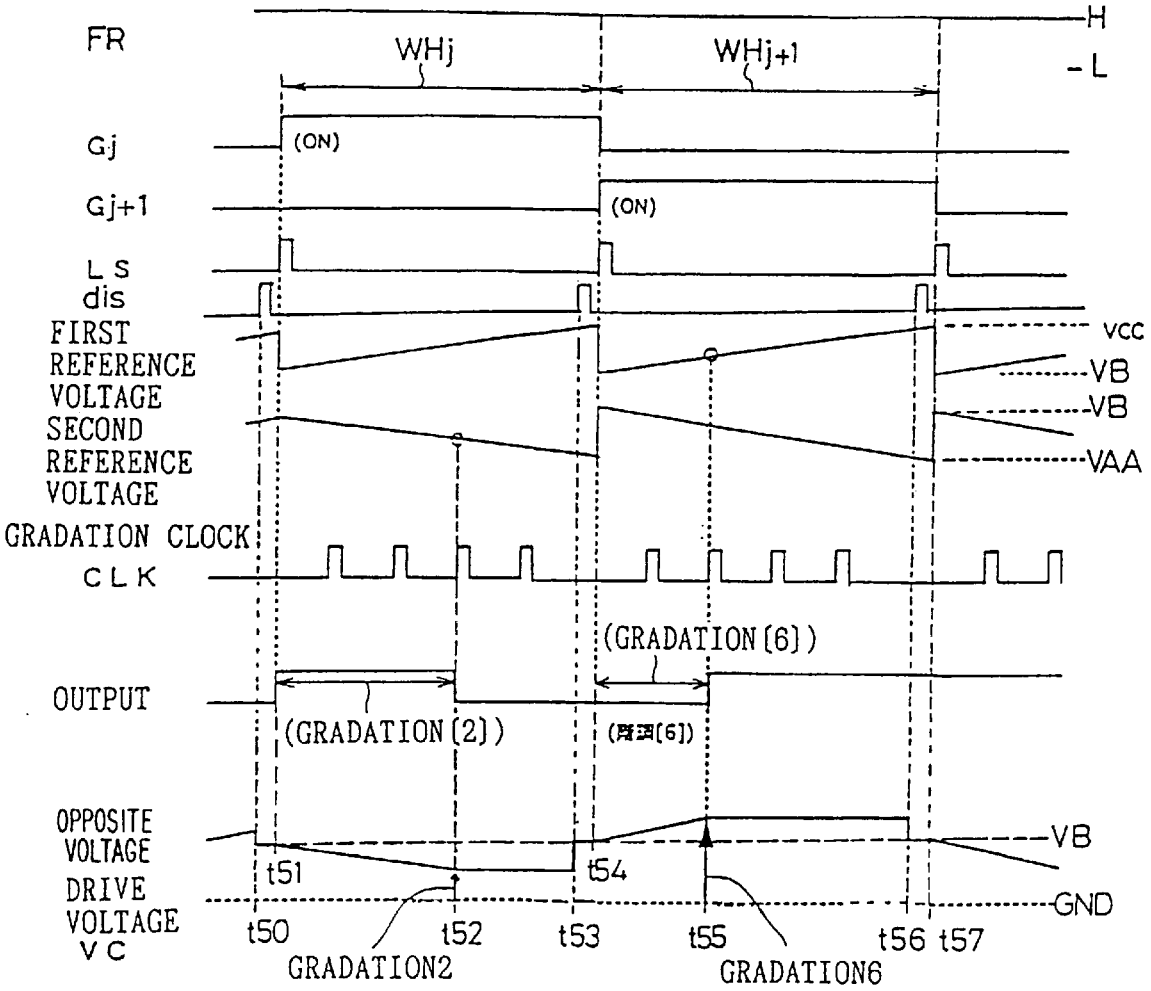
FIG. 19 is a timing chart illustrating the operation of the source driver 137*b* of a display apparatus 100*e* having still another configuration of the second embodiment.
Figure 20:
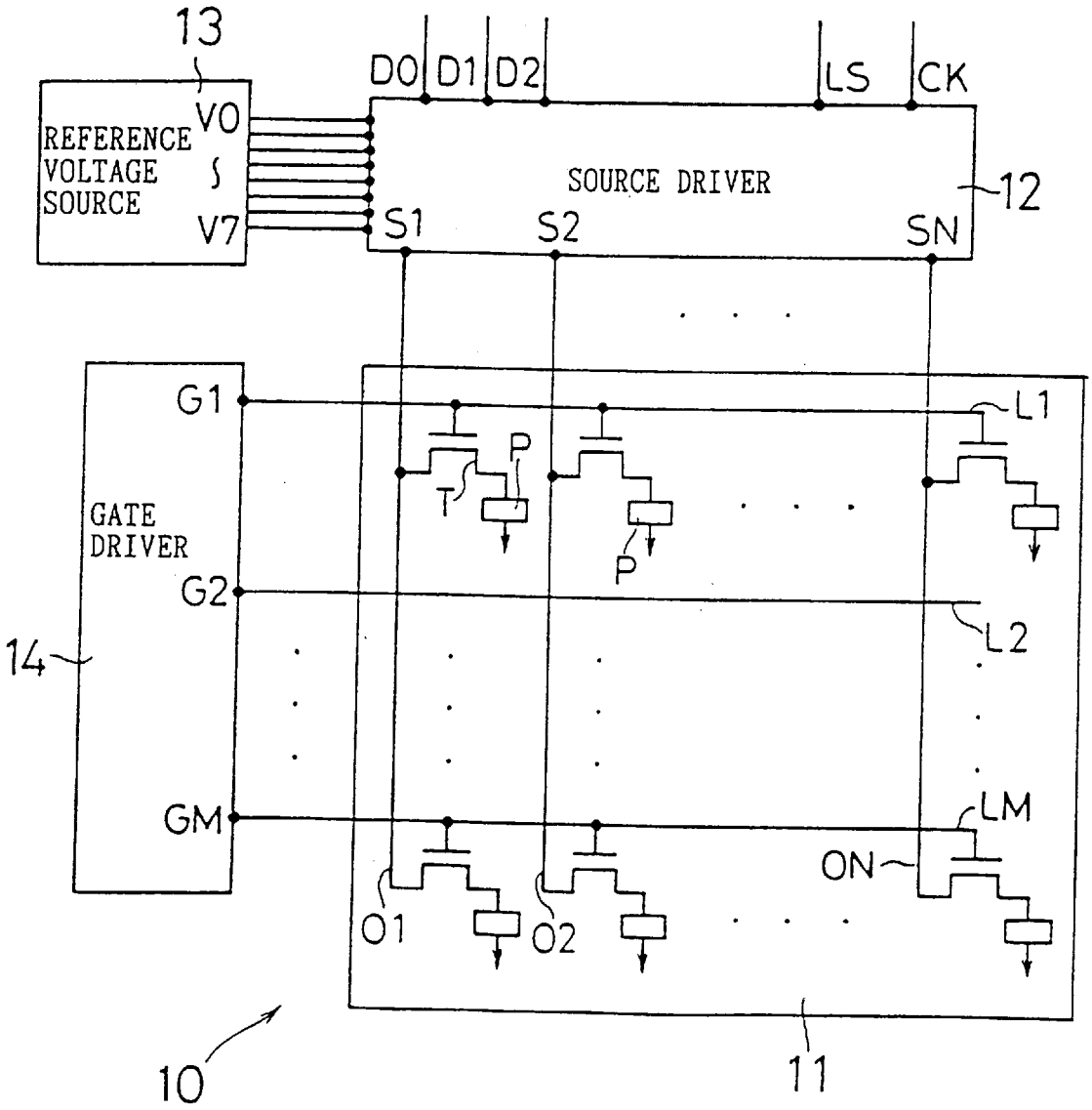
FIG. 20 PRIOR ART
FIG. 20 is a block diagram showing the configuration of a display apparatus 10 of a first prior art.
Figure 21:
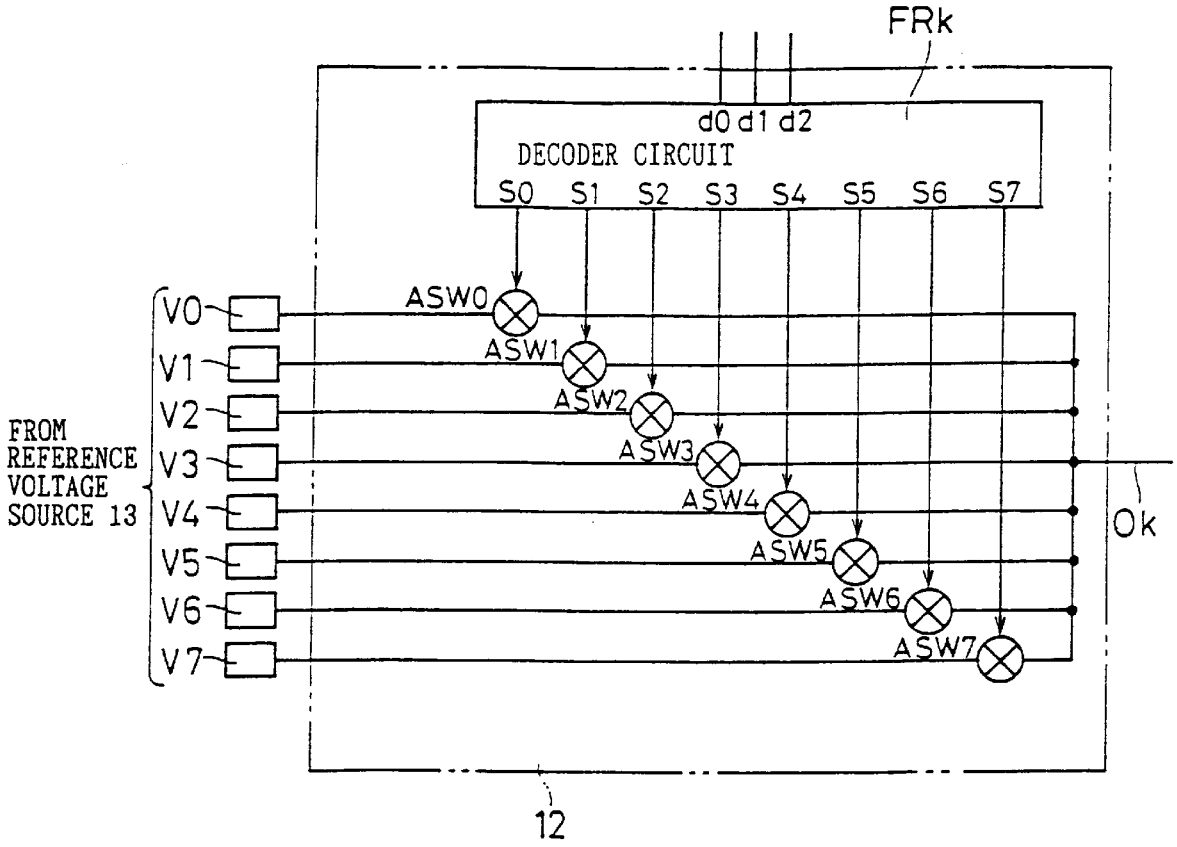
FIG. 21 PRIOR ART
FIG. 21 is a block diagram specifically showing part of the configuration of the source driver 12 of the display apparatus 10.
Figure 22:
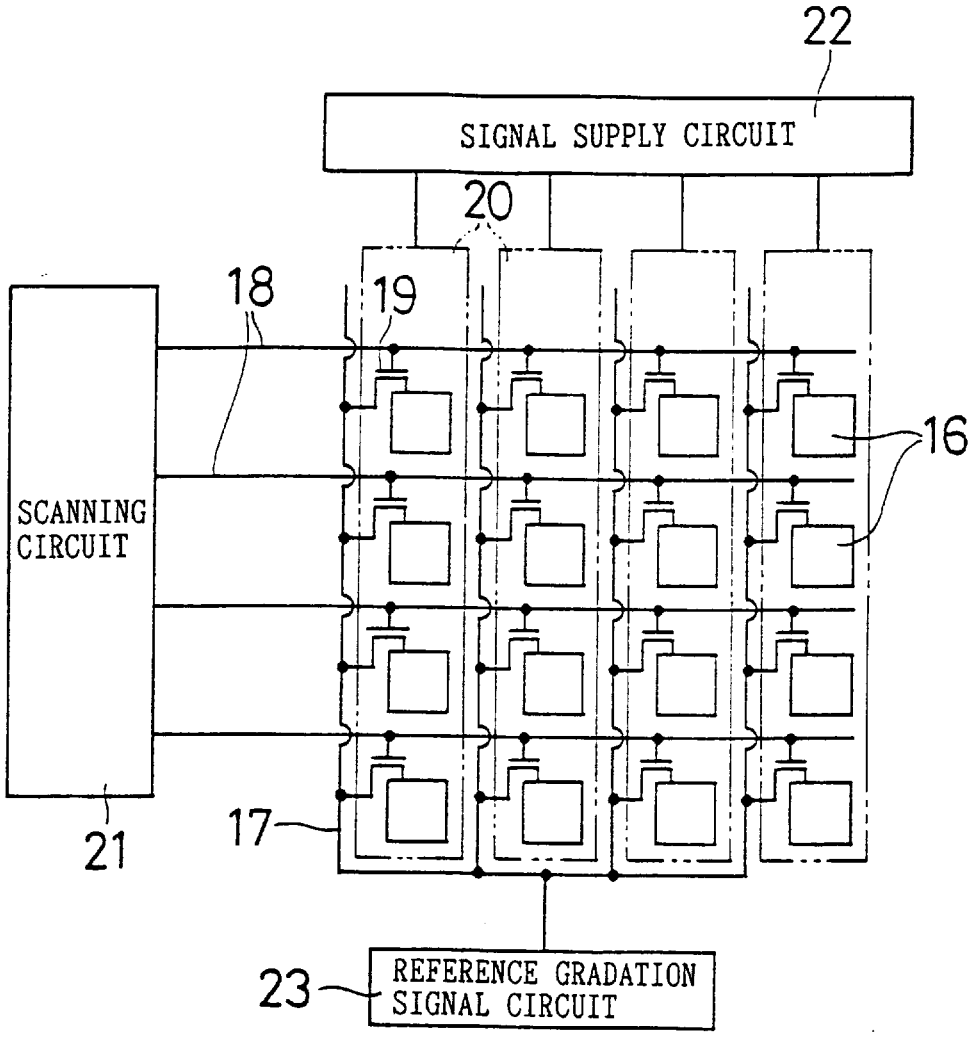
FIG. 22 PRIOR ART
FIG. 22 is a view showing the configuration of a second prior art.
Figure 23:
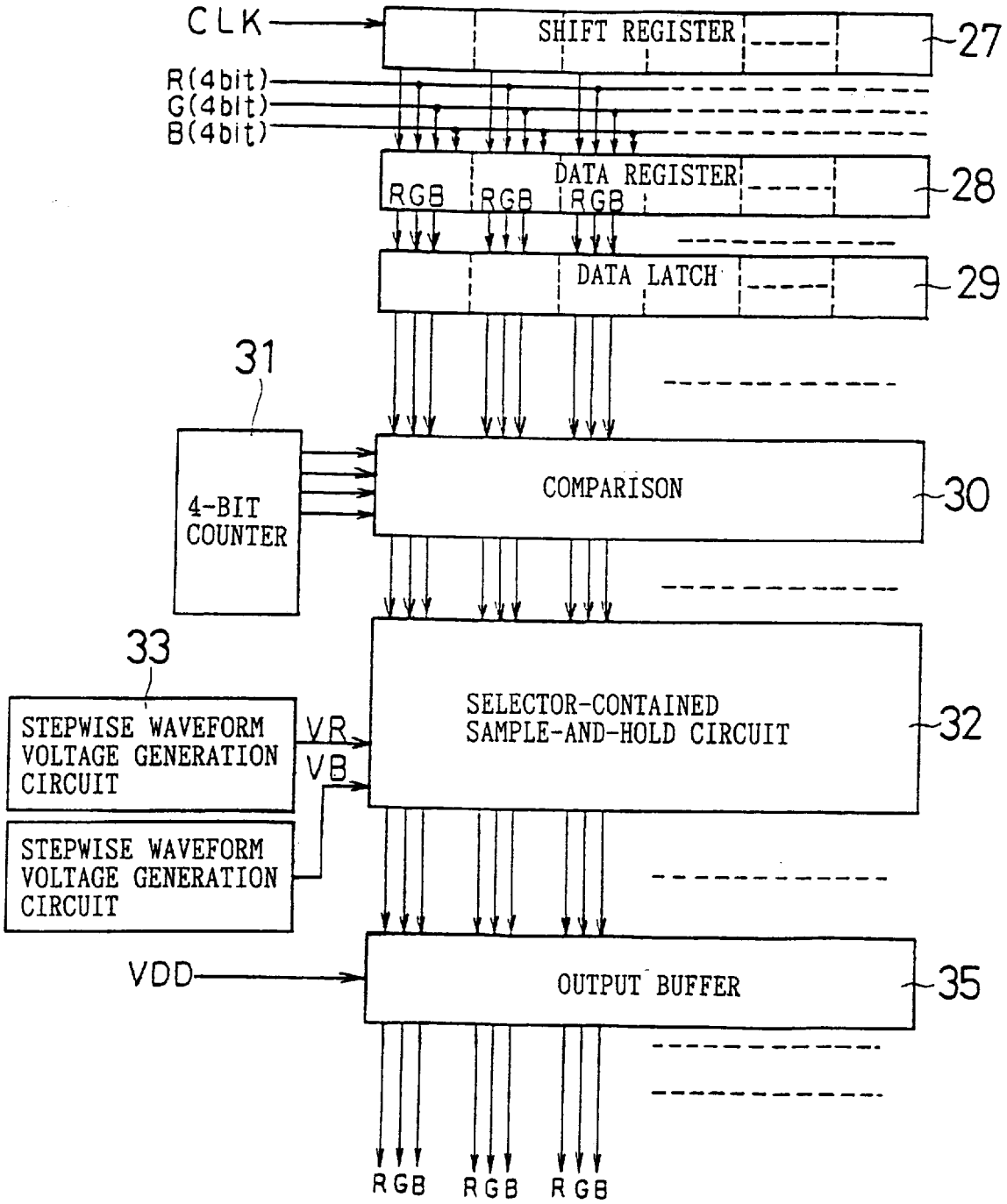
FIG. 23 PRIOR ART
FIG. 23 is a view showing the configuration of a third prior art.
Figure 24:
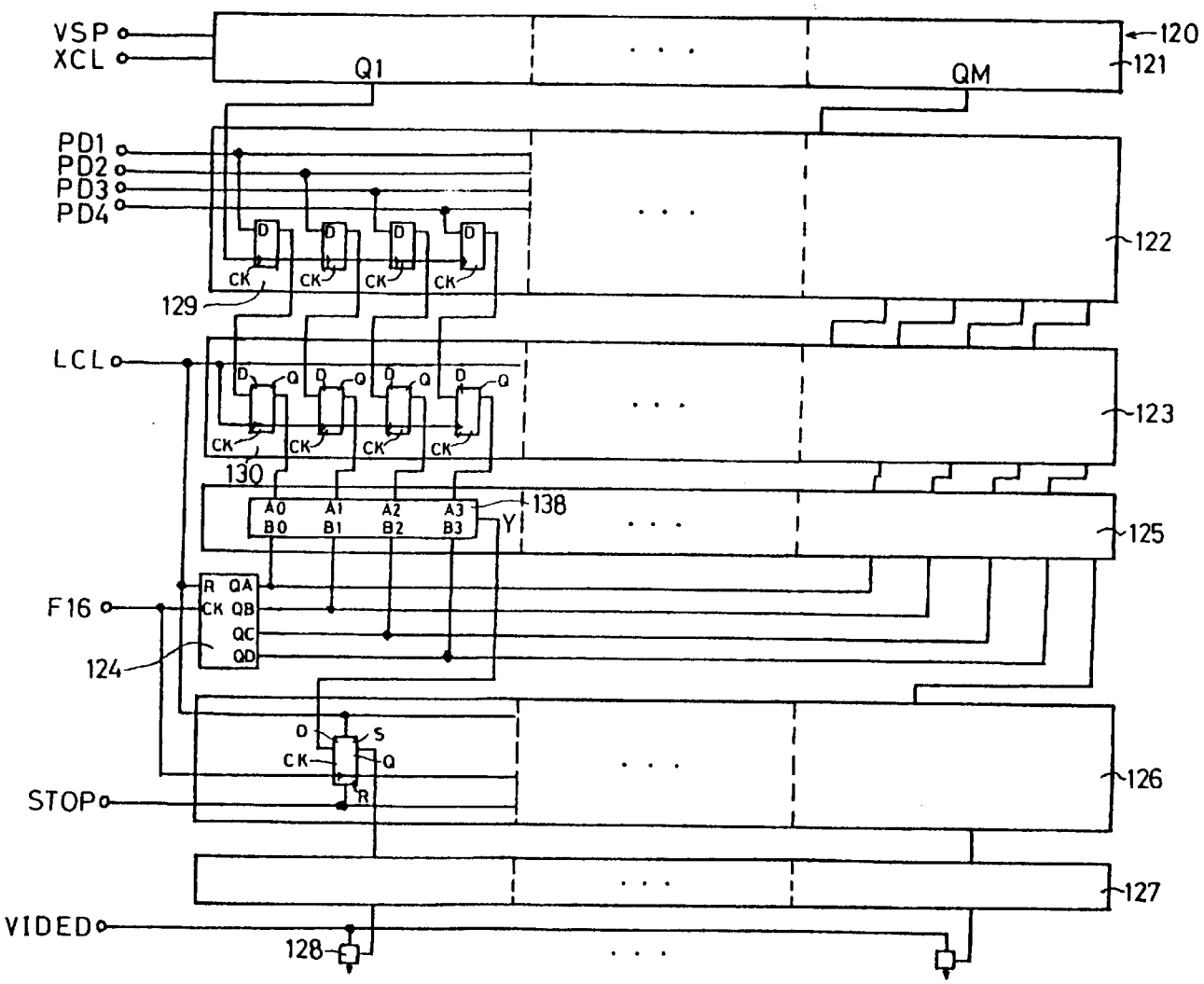
FIG. 24 PRIOR ART
FIG. 24 is a block diagram showing the configuration of an X driver 120 of a fourth prior art.
Figure 25:
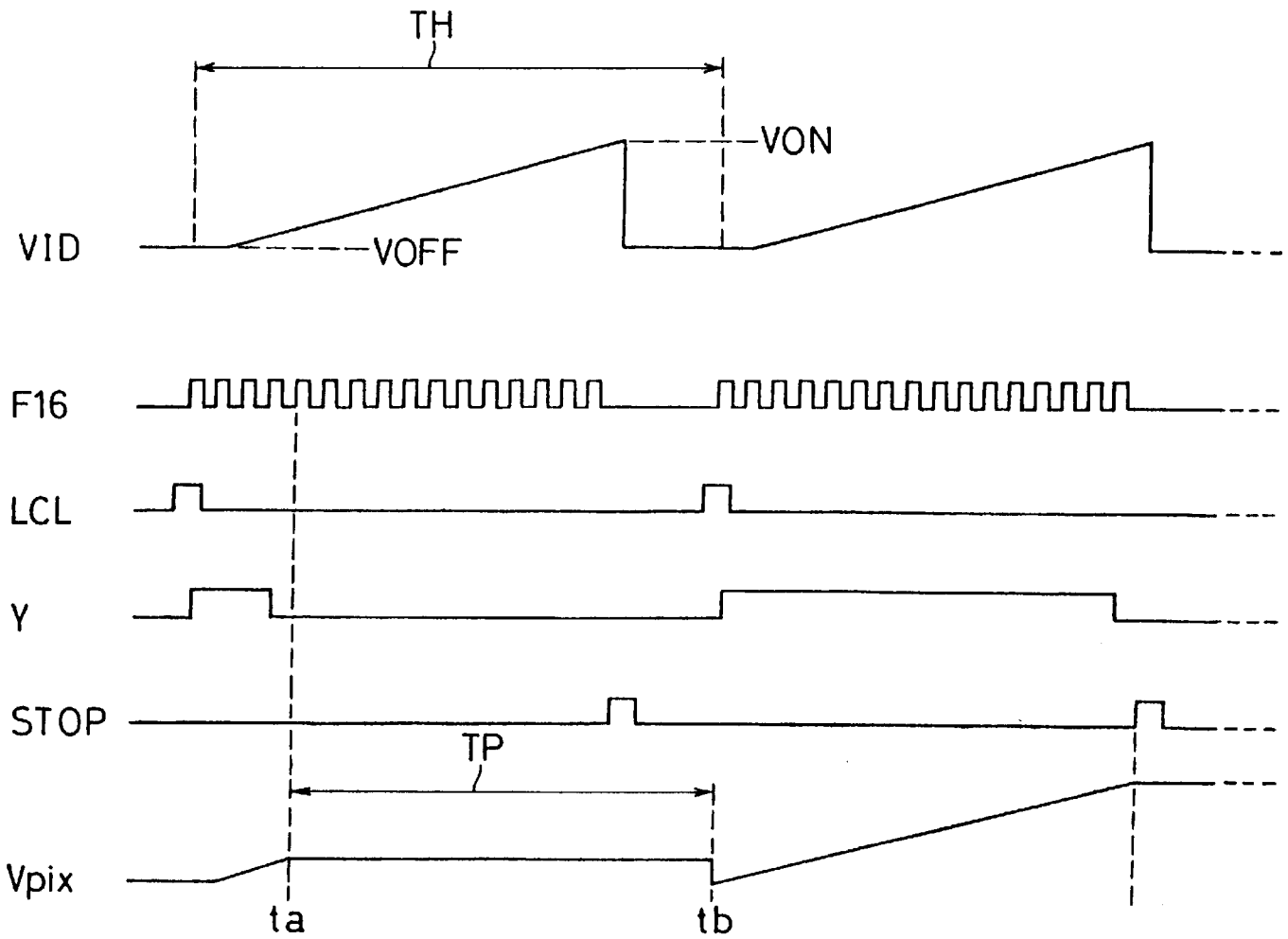
FIG. 25 PRIOR ART
FIG. 25 is a timing chart showing all signals in the X driver 120.

FIG. 19 is a timing chart illustrating the operation of the source driver 137*b* of a display apparatus 100*e* having still another configuration of the embodiment. Since the gate signals Gj, Gj+1, the hold signal LS, the discharge signal dis and the gradation clock signal CLK in FIG. 19 are the same as those shown in FIG. 17 respectively, these signals are not described here. It is assumed that in the horizontal scanning period WHj from time t51 to time t54, display is performed in accordance with number 2 of gradation levels, and that in the horizontal scanning period WHj+1 from time t54 to time t57, display is performed in accordance with the number of gradation levels of six.

The first reference voltage shown in FIG. 19 is the same as that shown in FIG. 14, and changes linearly from the voltage VB to the voltage VCC. Furthermore, the second reference voltage is the same as that shown in FIG. 14, and changes linearly from the voltage VAA to the voltage VB.

The output signal shown in FIG. 19 is high until time t52 wherein the gradation clock signal CLK rises at the third time, and the N-channel transistor SWib is turned on. The output signal in the period WHj is the output of the NOR circuit NOR3. When the transistor SWib is turned on, the drive voltage shown in FIG. 19 has the same waveform as that of the second reference voltage in the period from time t51 to time t52. After time t52 wherein the transistor SWib is turned off, the voltage at time t52 is held. When the discharge signal dis rises at time t53, the transistors TrP, TrN are turned on, and the drive voltage reaches the voltage VB.

In the period WHj+1, since the number of the gradation levels is 6, the output signal is low until time t55 wherein the gradation clock signal CLK rises at the second time, the P-channel transistor SWia is turned on, the first reference voltage is outputted until time t55, and the voltage at time t55 is held until t56 wherein the discharge signal dis rises. The output signal in the period WHj+1 is the output of the NAND circuit NAND2. After time t56, the output is the voltage VB until t57 wherein the next horizontal scanning period WH starts.

The charges retained in the liquid crystal element before the next gradation display data is written are discharged, and then the next gradation display data is written. Therefore, the display is not affected by the charges due to the gradation display data retained in the liquid crystal element, whereby a liquid crystal display apparatus of stable high display quality can be attained.

Although eight-level gradation display by using 3-bit gradation display data is mainly described in the above-mentioned embodiments, display can be made in more gradation levels by using more bits of data and by preparing more reference voltages corresponding to the number of data elements.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A display apparatus comprising:

a display panel for performing gradation display by applying a voltage across a pair of electrodes; and a voltage source for outputting a first voltage changing from a predetermined first potential to a second potential higher than the predetermined first potential, at intervals of a predetermined period, and a second voltage changing from the second potential to a third potential higher than the second potential, at intervals of the predetermined period, and applying one of the predetermined first potential and a potential lower than the predetermined first potential, or one of the third potential and a potential higher than the third potential, to a first electrode of the pair of electrodes of the display panel by switching at intervals of a multiple of the predetermined period; and a source driver supplied with the first and second voltages that applies one to one of the first and second voltages to a second electrode of the pair of electrodes.

2. The display apparatus of claim 1, wherein the first and second voltages linear-functionally change in the predetermined period.

3. The display apparatus of claim 1, wherein the first and second voltages shift stepwise in one of a rise and drop direction in the predetermined period.

4. The display apparatus of claim 1, wherein the source driver includes two switching devices which are supplied with the first and second voltages from the voltage source, respectively, and whose outputs are supplied to the second electrode, and turns on one of the switching devices, selected in accordance with gradation display data.

5. The display apparatus of claim 1, wherein the source driver includes driving means for sampling a voltage selected from the first and second voltages on the basis of data for performing gradation display at intervals of the predetermined period.

6. The display apparatus of claim 1, wherein the source driver includes a shift register that sequentially delivers a plurality of memory control signals to a plurality of source limes respectively, a data memory that stores a gradation display data in response to the memory control signals;

a selector that receives an AC-converting signal and converts the gradation display data based on a level of the AC-converting signal, a subtraction counter that receives a hold signal and stores and latches the gradation display data output from the selector corresponding with the source lines based on the hold signal;

a detection decoder that receives an output signal from the subtraction counter and delivers a predetermined signal based on the output signal, and a switch circuit that receives the predetermined signal and the first and second voltages and outputs voltages corresponding to the gradation display data at intervals of the predetermined period.

7. The display apparatus of claim 6, wherein the selector includes a plurality of selector circuits, each selector circuit receiving an element of the gradation display data and an inverted signal of the AC-converting signal.

8. The display apparatus of claim 6, further comprising a discharge circuit that receives a discharge signal and one of the first and second voltages, the discharge circuit including an analog switch having an input terminal connected between the switch circuit and an output terminal of the source driver.

9. The display apparatus of claim 1, wherein the display panel includes a low-pass filter connected to the source driver via a source line, the low-pass filter having a resistor connected to a capacitance of the source line and an equivalent capacitance of the second electrode that is smaller than the capacitance of the source line.

10. The display apparatus of claim 1, further comprising a display control that sequentially supplies a gradation display data to the source driver.

11. The display apparatus of claim 10, wherein the display control supplies a clock signal, a hold signal, a gradation clock signal, a start pulse signal and an AC-converting signal to the source driver.

12. The display apparatus of claim 11, further comprising a gate driver that supplies a plurality of gate signals to a plurality of gate lines connected to a plurality of pixels switching devices.

13. A method of driving a display panel for performing m-level gradation display (m: an integer of 2 or more) by application of a voltage across a pair of electrodes through a dielectric layer disposed therebetween, the method comprising the steps of:

dividing a range from a predetermined low potential to a high potential higher than the predetermined low potential into n potential segments (n: an integer divisor of m excluding 1 and m) and creating first to nth voltages changing from the predetermined low potential to the high potential, or from the high potential to the predetermined low potential, in each of the n potential segments in a predetermined period;

applying one of the predetermined low potential and a potential lower than the predetermined low potential, or one of the high potential and potential higher than the high potential to a first electrode of the display panel by switching at intervals of a multiple of the predetermined period; and selecting a voltage corresponding to a number of gradation levels for a desired display from among the first to nth voltages changing from predetermined low potential to the high potential, on the basis of the potential applied to the first electrode, applying the selected potential to a second electrode, and holding the voltage across the first electrode and the second electrode at the dielectric layer to perform gradation display.

14. The method of driving a display panel of claim 13, wherein the first to nth voltages change linear- functionally in the n potential segments.

15. The method of driving a display panel of claim 13, wherein the first nth voltages rise or drop in m/n steps in the potential segment.

16. A display apparatus comprising:

a display panel in which drive voltages supplied to a plurality of pixel electrodes disposed at intersections of a plurality of first and second lines arranged in a matrix from via the first lines, are supplied via a plurality of pixel switching devices turned on by a pixel control signal supplied via the second lines, and a constant reference voltage is applied to a common electrode disposed facing opposite to the pixel electrodes, whereby potential differences are obtained between the pixel electrodes and the common electrode to perform a gradation display; second line driving means for sequentially supplying the pixel control signal to the second lines in a plurality of predetermined horizontal scanning periods to turn on the pixel switching devices connected to the second lines;

a voltage source for generating a voltage which one of rises and drops stepwise with time in each horizontal scanning period, wherein the voltage source generates:

a first voltage which one of rises stepwise from a predetermined first potential to a second potential higher than the predetermined first potential, and drops stepwise from the second potential to the predetermined first potential, and a second voltage which one of rises stepwise from the second potential to a third potential higher than the second potential, and drops stepwise from the third potential to the second potential, and wherein one of the predetermined first potential and one of the third potential and a potential higher than the third potential is applied as the constant reference voltage to the common electrode by switching at intervals of a predetermined period; and first line driving means for applying one of the first and second voltages in accordance with a gradation display data to the pixel electrodes via respective first lines in the horizontal scanning period.

17. The display apparatus of claim 16, wherein the first driving means includes:

gradation display generation means for delivering the gradation display data in serial bits sequentially for each of the first lines in the horizontal scanning period;

a data latch circuit that delivers the gradation display data in parallel bits from the gradation display data generation means while latching the gradation display data in each horizontal scanning period;

gradation clock signal generation means for sequentially generating gradation clock signals having a higher number than a number of gradation levels used for the gradation display, in each horizontal scanning period;

first and second voltage application switching devices disposed between the voltage source and the pixel electrodes and supplied with the first and second voltages, respectively; and switching control means for applying voltages to the pixel electrodes by turning on and off the voltage application switching means in response to outputs of the data latch circuit after a lapse of time corresponding to the gradation display data, the switching control means including a subtraction counter, wherein a value corresponding to the gradation display data is set and the value is subtracted each time the gradation clock signal is received, and controlling the on/off operation of the first and second voltage application switching devices when the value of the subtraction counter reaches predetermined value.

18. The display apparatus of claim 16, wherein the first and second voltage application switching devices are analog switches.

19. The display apparatus of claim 17, wherein the first and second voltage application switching devices are P-channel type MOS transistor in the case where the first and second voltages which rise stepwise are supplied, and are N-channel type MOS transistors in the case where the first and second voltages which drop stepwise are supplied.

20. The display apparatus of claim 17, wherein an analog switch which is turned on at the end of each horizontal scanning period to supply the second potential to the pixel electrodes is disposed between the first and second potential application switching devices and pixel electrode.

* * * * *